US008967293B2

(12) United States Patent
Von Rohr et al.

(10) Patent No.: US 8,967,293 B2
(45) Date of Patent: Mar. 3, 2015

(54) ROCK DRILLING IN GREAT DEPTHS BY THERMAL FRAGMENTATION USING HIGHLY EXOTHERMIC REACTIONS EVOLVING IN THE ENVIRONMENT OF A WATER-BASED DRILLING FLUID

(75) Inventors: Philipp Rudolf Von Rohr, Muttenz/BL (CH); Tobias Rothenfluh, Zürich (CH); Martin Schuler, Zürich (CH)

(73) Assignee: ETH Zurich, Zurich (CH)

( * ) Notice: Subject to any disclaimer, the term of this patent is extended or adjusted under 35 U.S.C. 154(b) by 767 days.

(21) Appl. No.: 13/141,349

(22) PCT Filed: Dec. 22, 2009

(86) PCT No.: PCT/EP2009/009231

§ 371 (c)(1), (2), (4) Date: Sep. 1, 2011

(87) PCT Pub. No.: WO2010/072407

PCT Pub. Date: Jul. 1, 2010

(65) Prior Publication Data

US 2011/0303460 A1 Dec. 15, 2011

(30) Foreign Application Priority Data

Dec. 23, 2008 (EP) ..... 08022356

(51) Int. Cl.
*E21B 7/14* (2006.01)

(52) U.S. Cl.
CPC ..... *E21B 7/14* (2013.01)
USPC ..... 175/11; 175/12

(58) Field of Classification Search
CPC ..... E21B 7/14; E21B 7/18
USPC ..... 175/11–17, 65, 71, 424
See application file for complete search history.

(56) References Cited

U.S. PATENT DOCUMENTS

| | | | | |
|---|---|---|---|---|
| 2,327,508 | A * | 8/1943 | Craig | 175/15 |
| 2,675,993 | A * | 4/1954 | Smith et al. | 175/14 |
| 2,794,620 | A * | 6/1957 | Arnold et al. | 175/14 |
| 2,882,017 | A * | 4/1959 | Napiorski | 175/14 |
| 2,896,914 | A * | 7/1959 | Ryan | 175/14 |
| 3,171,479 | A * | 3/1965 | Parrish et al. | 166/261 |

(Continued)

FOREIGN PATENT DOCUMENTS

| | | |
|---|---|---|
| WO | 96/03566 A2 | 2/1996 |
| WO | 02/103152 A1 | 12/2002 |

*Primary Examiner* — Kenneth L Thompson
(74) *Attorney, Agent, or Firm* — Rankin, Hill & Clark LLP

(57) ABSTRACT

A method and a device to thermally fragment rock for excavation of vertical and directional boreholes in rock formations, preferentially hard rock, using highly exothermic reactions. Exothermic reactions are initiated directly in the pressurized, aqueous environment of a water-based drilling fluid preferably above the critical pressure of water (221 bar). After reaction onset temperatures within the reaction zone exceed the critical temperature for water (374° C.) providing supercritical conditions, which favor the stabilization of the reaction, e.g. a supercritical hydrothermal flame. Since reactions can be run directly in a water-based drilling fluid, the method proposed here allows high density drilling action as in conventional rotary drilling. A part from the hot reaction zone of the proposed reaction can be brought directly to the rock surface in case of hard polycrystalline rock, where high temperatures are required.

29 Claims, 12 Drawing Sheets

(56) References Cited

Figure 1:
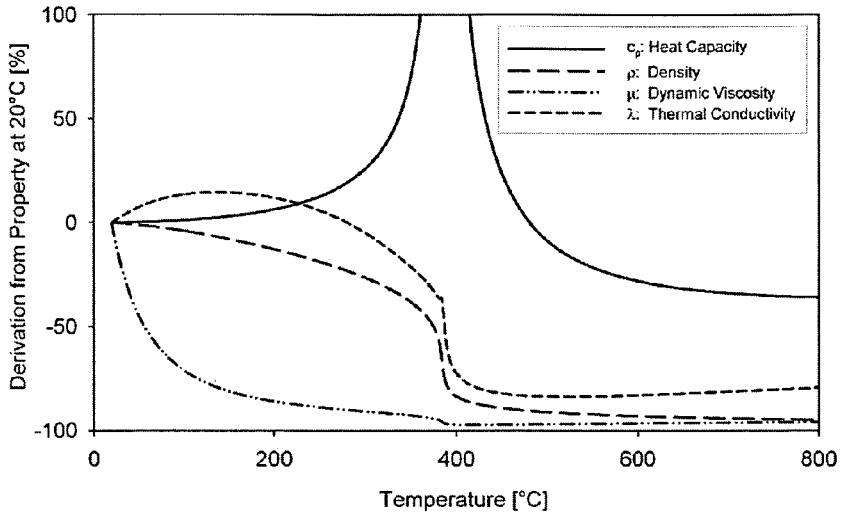

U.S. PATENT DOCUMENTS 3,467,206 A * 9/1969 Acheson et al. ..... 175/13
3,791,697 A * 2/1974 Hokao et al. ..... 299/14
4,190,121 A * 2/1980 Baum et al. ..... 175/14
5,771,984 A 6/1998 Potter et al.
8,235,140 B2 * 8/2012 Wideman et al. ..... 175/11

* cited by examiner 115
106
111
105
101
107
104
103
reaction start without aid
reaction start with aid
continuous operation
Temperature
Depth in Formation
1
2
3
4
5

A'
A
117c
117a
117b
117
X
103
108
116
109
110
111
114
112
113
101
102
115
104
105
107

Fig. 12A
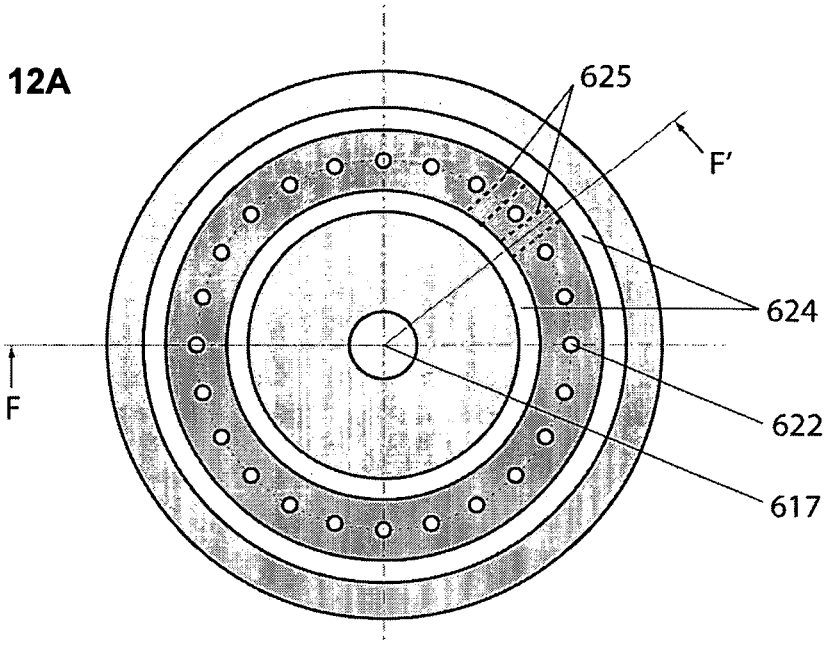
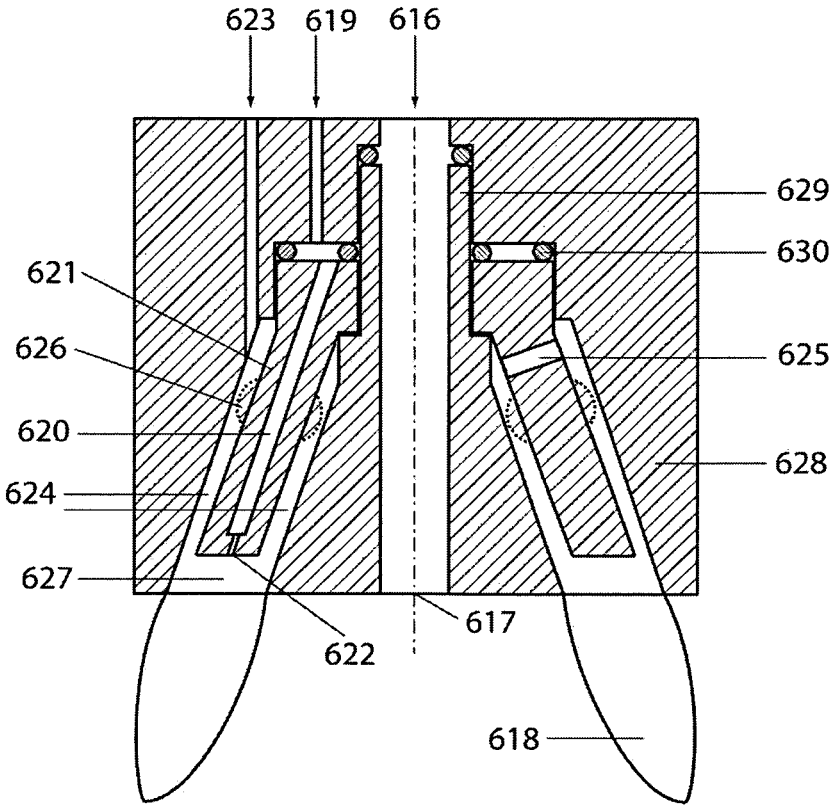
Fig. 12B

ROCK DRILLING IN GREAT DEPTHS BY THERMAL FRAGMENTATION USING HIGHLY EXOTHERMIC REACTIONS EVOLVING IN THE ENVIRONMENT OF A WATER-BASED DRILLING FLUID

In the rock drilling technology there are basically two drilling techniques, which became widely accepted:

Conventional Rotary Drilling

The conventional rotary drilling concept is based on the mechanical abrasion of rock material by a drill bit made of hard materials that is in direct mechanical contact with the rock. Even though materials such as PDC (polycrystalline diamond compact) for penetrating hard rock formation have been developed, the rotary drilling technique is especially appropriate for softer and sedimentary rock formation, because less attrition of the drill bit occurs.

The drill bit is connected to a rotary and stiff drill string which transfers the torque energy from the motor at the rig to the downhole assembly. The drilling process is assisted by the circulation of a drilling fluid. (e.g. water-based or oil-based mud), which is pumped down through the interior of the drill string, ejected through nozzles at the drill bit and re-circulated in the annular region between borehole wall and drill string. The main functions of the drilling fluid in conventional rotary drilling methods are the cooling of the downhole assembly, the prevention of fluid loss through the formation, the suspension of cuttings, the transport of cuttings to the earth surface, the stabilization of the bore well and optionally the powering of a downhole drive. The borehole completion including casing and cementing of the borehole prevents the borehole from collapsing due to stresses in the rock formation and avoids potential blowouts from high pressure zones.

The drill bit of a conventional rotary drilling rig is constantly exposed to mechanical friction and consequently has to be replaced from time to time, especially in hard rock formations. The replacement of the drill bit requires pulling out the whole drill string and re-running it into the borehole again after substitution of the drill bit. This leads to a significant downtime of the drilling rig, which makes this process uneconomical for drilling in great depth and in hard rock formations.

There is a wide field of application for this technology, for example in the extraction of fossil energy resources and drinking water, as well as in accessing geothermal energy in great depth.

Thermal Fragmentation Drilling Method

Thermal Fragmentation is a technical term for the method of disintegrating rock by locally heating it up to high temperatures, thus inducing high thermal gradients and therefore stresses inside a thin rock layer finally resulting in a failure of the material. Within this process small, disc-like rock fragments are violently ejected from the rock surface. This mechanism is also known as thermal rock spallation, whereas the associated drilling process using this technique is called spallation drilling.

In spallation drilling hot flame jets of high velocity, hot water jets or even powerful laser beams can be directed towards the rock to induce the high temperature gradients and thus the thermal stresses required to spall the rock within the surface layer.

Spallation drilling is particularly suited for drilling through hard, polycrystalline rock formations, which can hardly be drilled mechanically with conventional rotary methods, but easily be spalled. Such hard rock formations are especially met in the basement rock in great depth.

Feeding the downhole assembly from the earth's surface can be realized in a piping (flexible) or a string based (stiff) system. Both vertical and directional drilling is possible with this method. The utilities that have to be fed downhole during the spallation flame jet process are mainly electricity, fuel and oxidant (e.g. air). Oxidant and fuel are electrically heated up before entering the combustion chamber. There, the fuel is burnt forming hot gaseous reaction products, which are accelerated in a nozzle and directed towards the rock surface. For lifting the spalled rock away from the removal site the flow of the exiting combustion gases is typically not sufficient. Therefore the use of additional air is suggested for instance.

Applications of spallation drilling in Russia and the Ukraine using flame jets under ambient air conditions to drill large diameter holes into ore veins in surface mining have been reported. It has been shown that thermal rock fragmentation works well under ambient conditions and with certain rock types, preferentially hard, polycrystalline rocks.

However, the known spallation drilling technology only works in an aerially environment at the borehole front. I.e. no drilling fluid can be applied with this technology.

Advantages of Spallation Drilling in Comparison with Conventional Drilling

The costs in conventional rotary drilling generally increase exponentially with depth, mainly due to the fast wear out and thus the replacement of the drilling bit, especially in the case of hard rock formations in great depths. Therefore, considerable and expensive down times are inevitable when using conventional rotary drilling methods. The spallation drilling technology seems to overcome this economic shortcoming. The fact that spallation drilling is economically advantageous over conventional drilling is based on the fact that spallation drilling is a contact-free drilling technique. The drill head and the rock being drilled do not have direct physical contact with each other during drilling operation. Therefore the drill head does not suffer from attrition and a frequent replacement of the drill bit as met in conventional rotary drilling technology can be avoided. It is mainly the significant decrease in dead times associated with drill bit replacements that makes spallation drilling an economically interesting process, particularly for deep boreholes in hard rock formations.

There is a general correlation between spallability (ability of being penetrated by spallation (heat)) and drillability (ability of being penetrated by mechanical drill bits) of rock: The higher the spallability of a rock, the worse its drillability and vice versa. This fact again favors the application of spallation drilling in great depths where hard, polycrystalline rock formations are met, which can hardly be drilled mechanically, but easily be spalled.

In the state of the art a major concern regarding spallation drilling technology was addressed: Spallation drilling might never be realized for drilling operations in great depth, because of the drilling fluid present in most boreholes. Since igniting and operating flames in water was considered as not being possible, it was argued that a spallation drilling device can presumably only be operated in air and not in aqueous environments as those found downhole.

SUMMARY OF THE INVENTION

It is therefore an object of the present invention to provide a new method for thermal spallation drilling that may be employed in aqueous environments.

This object is achieved by a method of thermal rock fragmentation in the borehole by an exothermic chemical reaction of at least two reactants in the presence of a water-based drilling fluid having a pressure of more than 1.5 bar, the method comprising:

a. feeding the water-based drilling fluid to a downhole assembly in a borehole and ejecting said drilling fluid from the downhole assembly into the borehole;
b. feeding the reactants for said exothermic reaction via feeding lines to said downhole assembly;
c. forming a mixing zone by bringing the reactants together via outlets in the feeding lines and mixing said reactants in the mixing zone;
d. establishing the exothermic reaction of the reactants in a reaction zone, the reaction zone being located in a volume (space) between the outlets of the feeding lines into said mixing zone and a rock surface in the borehole, wherein the reaction at least partly takes place in the presence of water-based drilling fluid .

Some important technical terms used in the following description of the invention are shortly explained here:

Hydrothermal Flame

The term "hydrothermal flame" in connection with this patent refers to a combustion reaction primarily between a fuel and an oxidant taking place in an aqueous environment (e.g. in water). In principle hydrothermal flames can establish at all pressure levels. However, pressures exceeding the critical pressure of water (221 bar) strongly favour combustion processes in a water environment, as the supercritical state of water in and around the flame (temperatures beyond the critical temperature of water (374° C.)) enhances transport processes and the dissolution of the participating oxidant.

Mixing Zone

The mixing zone begins where the reactive species (reactants) get in contact with each other. This actually happens at the outlets of the feeding lines of the reactants in the downhole assembly. When the reactants are partly mixed, the chemical exothermic reactions can be ignited and established according to the local conditions.

Reaction Zone

The reaction zone covers the whole region, where the exothermic reaction between two or more reactants is still ongoing. Note that in the following description the term "reaction zone" can also be attributed to neighbouring and still hot regions where no reaction occurs anymore. It can be seen from the definitions that mixing and reaction zone can also be overlapping. The reaction zone can be shifted in between the outlet of the feeding lines for the two or more reactants and the rock surface being fragmented depending on the applied operating conditions and according to the local requirements to spall the rock.

Drilling Fluid

The term "drilling fluid" refers to relatively pure water or water containing one or more functional additives and/or other impurities and/or substances without defined functions. This latter type of drilling fluid containing functional additives is sometimes also referred to as "water-based drilling mud" in literature. The drilling process is assisted by the circulation of such a drilling fluid, which is pumped downhole, ejected into the borehole and re-circulated in the annular region between borehole wall and drill string. The main functions of the drilling fluid in conventional rotary drilling methods are the cooling of the downhole assembly, the prevention of fluid loss through the formation, the suspension of cuttings, the transport of cuttings to the earth surface, the stabilization of the bore well and optionally the powering of a downhole drive. In case of this newly developed method for thermal rock fragmentation, the drilling fluid has several additional tasks to fulfil in comparison to the functions mentioned above.

The water-based drilling fluid can also be used to adapt the hot impinging reaction mixture's temperature as well as the momentum and energy transfer to the rock surface, when at least a portion of the drilling fluid is additionally mixed with the at least two reactants in the mixing and/or reaction zone of the downhole assembly: When for e.g. water (or water with functional additives) is used as drilling fluid, it does not directly participate in the chemical exothermic reaction of the reactive species (reactants) and can therefore be seen as relatively inert component that is used as an energy and momentum carrier towards the rock surface. With the drilling fluid being injected at least partly into the mixing and/or reaction zone reactants and/or hot reaction products can be diluted to a certain extent. Using hydrothermal flames for instance the combustion reaction can still be sustained despite of the water-based drilling fluid being injected to the mixing and/or reaction zone. The water-based drilling fluid can be seen as a kind of reaction media, wherein the combustion reaction can take place. Especially in the case of supercritical conditions oxidant and fuel can both be dissolved in water and transport and mixing processes are considerably enhanced and favour the combustion reaction. Yet another possibility offers the addition of drilling fluid to a single reactant prior to entering the mixing chamber (e.g. adding water to a fuel uphole).

The amount of drilling fluid injected and mixed to the hot reaction mixture offers an additional degree of freedom to set velocity and/or temperature of the hot reaction mixture impinging on the rock surface. This not only allows for a better adjustment to the requirements of various rock types concerning heat and momentum transfer to obtain rock failure, but also helps keeping temperatures low enough to avoid undesired rock fusion. Apart from heat transfer, also momentum transfer to the rock is a crucial parameter to enable rock fragments to get separated from the bulk. To sum up, injecting at least a part of the drilling fluid provided into the mixing and/or reaction zone offers a further possibility (apart from e.g. mass flow rates of reactants, nature of reactants, etc.) to adapt the spallation process according to the local requirements met downhole.

Hot Reaction Mixture

In connection with this patent, the term "hot reaction mixture" refers to a hot mixture of one or more of the following components: reactants, reaction products, drilling fluid as a more or less inert component not participating in the reaction and other substances without explicit functions attributed to them (e.g. side products, inert substances). The hot temperature of this mixture is owing to the exothermic reaction and it is typically this hot reaction mixture which impinges on the rock surface, transfers energy and momentum to the rock and finally provokes rock failure. This hot reaction mixture can be present inside and outside (i.e. in the borehole) the downhole assembly.

Drilling

In connection with this patent the expression "drilling" means a process for excavation of rock material, e.g. from a borehole. The excavation of material can be realized by a mechanical, a chemical, a thermal process or a combination thereof.

The expression "exothermic reaction in the presence of water-based drilling fluid" in connection with this patent mainly refers to one or both of the following situations:

1. the reactants and reaction products of the ongoing exothermic reaction are well mixed with at least a part of the water-based drilling fluid, preferably at supercritical conditions for water. In this case the water-based drilling fluid (e.g. water) serves as a kind of reaction media for the exothermic reaction and reactants, reaction products and drilling fluid coexist at least partly in the same volume.

2. the exothermic reaction takes place in a more or less separated volume adjacent to another volume of mainly drilling fluid. In this case there is a boundary separating the volume of mainly drilling fluid from another volume where there are mainly reactants and reaction products of the exothermic reaction. Of course, even here the zone of the reaction and that of the drilling fluid can also be partly interpenetrating.

The reaction zone can lie inside and/or outside the downhole assembly. The water-based drilling fluid can be directly injected into the borehole or can be injected via an inside part of the downhole assembly (e.g. mixing chamber). The water-based drilling fluid has preferably a pressure of more than 10 bar, advantageously more than 100 bar and most preferably a pressure corresponding to or exceeding the critical pressure of water.

It is a further object to provide a downhole assembly specifically adapted for carrying out such a method. This object is achieved by a downhole drilling assembly comprising:

a. inlets for reactants and water-based drilling fluid;
b. a mixing chamber, in which the mixing and optionally at least part of the reaction of said reactants are realized, and wherein feeding lines of the reactants end in the mixing chamber via outlet openings;
c. outlet nozzles for the hot reaction mixture;
d. means for direct and separate injection of water-based drilling fluid into the borehole and/or means for injection of water-based drilling fluid in the mixing chamber and/or means for injection of water-based drilling fluid through the outlet nozzle for the hot reaction mixture.

A preferred embodiment of the method comprises the steps of:

a. introducing a downhole assembly into the borehole;
b. feeding said drilling fluid to said downhole assembly and ejecting said drilling fluid from the downhole assembly into the borehole;
c. feeding the reactants for said exothermic reaction to said downhole assembly, the downhole assembly having a mixing zone;
d. mixing said reactants in the mixing zone;
e. forcing mixture of said reactants to leave said downhole assembly;
f. establishing said exothermic reaction of the reactants in a reaction zone, the reaction zone being located somewhere between said mixing zone and a rock surface in the borehole and taking place at least partly in the presence of a water-based drilling fluid.

The hot reaction mixture can be ejected from the downhole assembly through outlet nozzles. The outlet nozzles can separate the reaction zone outside the downhole drilling assembly and the mixing and/or reaction zone inside the downhole assembly. The reaction zone can also overlap with the mixing zone, so that at least a part of the reaction takes place in the mixing zone. On the other hand both mixing zone and reaction zone can be located at the inside of the downhole assembly.

The mixing zone can be placed inside the downhole assembly, so that a hot reaction mixture is ejected through the outlet nozzles towards the rock. The mixing zone can also be outside the downhole assembly, so that the reactants are ejected through separate outlet nozzles into the space (volume) between downhole assembly and rock surface and are mixed outside the downhole assembly in the presence of a drilling fluid.

In the mixing zone advantageously the same pressure condition or even a higher pressure occurs than in the drilling fluid in the borehole at the ejection points of the reactants or the hot reaction mixture outside the downhole assembly. Means can be provided to generate said high pressure in the mixing zone. The inflow of the reactants and, optionally of drilling fluid, into the mixing chamber can be controlled by means of valves or mass flow controllers. The drilling fluid and/or the hot reaction mixture can be ejected into the borehole in any direction, e.g. laterally or vertically downwards.

The downhole assembly preferably has a bottom side which is directed to the rock surface to be spalled. The bottom side is directed to the end face of the borehole. Some or all of the nozzles are preferably placed on this bottom side. The bottom side is preferably perpendicular to the central axis of the downhole assembly, i.e. of the borehole at the location of the downhole assembly. The bottom side can be flat, concave, convex, or otherwise be formed.

The flow of the hot reaction mixture can be directed towards the rock surface, while the exothermic reaction is ongoing or even after the exothermic reaction has been finished so as to cause said hot reaction mixture to impinge on the rock surface. The reactants can also be directed towards the rock, before the reaction has been started, and mix outside the downhole drilling assembly the reaction zone establishing between the outlets of the drilling assembly and a rock surface.

The rock cuttings formed at a rock surface are flushed away with the drilling fluid and/or the hot reaction mixture ejected from said downhole assembly. The high momentum of the stream of the hot reaction mixture especially when containing also a portion of water-based drilling fluid (e.g. water) can also help separating rock fragments from the rock bulk after cracks in the formation have been formed. The drilling fluid containing other components (e.g. reaction products) is circulated together with the cuttings back to the surface in an annular region between a drill string connected to the downhole assembly and the borehole wall. The drilling fluid flowing back to the surface can be cleaned uphole by removing the cuttings and other impurities. Subsequently the drilling fluid can be re-injected into the borehole after cleaning.

The reactants, optionally with a portion of drilling fluid are preferably preheated in a preheating zone of said downhole assembly before, during or after mixing by providing heating power to said reactants. The heating power for preheating the reactants can be reduced after the exothermic reaction has been established and stabilized.

The drilling fluid is preferably water or can comprise water combined with one or more functional additives. The drilling fluid can also be a water-based mud, with or without further functional additives.

In a further development of the drilling fluid supply, all or some of the functional additives are added to the drilling fluid at the downhole assembly. In a particular embodiment of the invention, a drilling fluid without any additives, e.g. water, or water with only some additives is ejected from the downhole assembly to the spallation drilling zone where the hot reaction mixture is present during a heating period, whereas drilling fluid with one or more additional additives, or only the additional additive(s) are ejected from the downhole drilling assembly at another location into the borehole outside the spallation drilling zone. The drilling fluid additives can be brought to the downhole assembly through one or more separate conduits. Some additives can also be separated from the drilling fluid downhole. In such a case it can be possible to have only one conduit for the drilling fluid. The drilling fluid additives can e.g. be injected into the upward stream (drilling fluid, unused reactants, reaction products, cuttings) in an annular region at an upper part of said downhole assembly, thus creating an aqueous reaction zone in a bottom region of the borehole and a separate upward stream region containing said drilling fluid additives.

The hot reaction mixture or one or more of the reactants can be subjected to a mass flow having oscillatory variations over time, thus providing time-dependent heat flux to the rock and inducing enhanced temperature gradients within the upper rock layers close to the reaction zone. The variations of the mass flow can be realized by pulsations in pressure leading to a permanent, oscillating movement of the hot regions between the mixing zone of the downhole assembly and the rock surface.

Additionally or alternatively to the mass flux variation of the hot reaction mixture over time also the drilling fluid can have a mass flow that is subjected to variations over time, thus providing time-dependent cooling of the rock surface and inducing enhanced temperature gradients within the upper rock layers close to the reaction zone. For this the drilling fluid leaving the downhole assembly can be subjected to pulsations in pressure leading to periodically varying cooling conditions for the rock surface.

The drilling fluid and/or the hot reaction mixture is preferably ejected from said downhole assembly at a plurality of nozzles in the downhole assembly. The distribution of the total mass flow to each single of said nozzles can be varied over time to provide temporally and spatially varying cooling and/or heating conditions to the rock surface, whereas the total mass flows remain constant or are varied as well over time.

There are many possibilities of nozzle arrangements in the downhole assembly for the output of the drilling fluid and the hot reaction mixture. The drilling fluid can be ejected from said downhole assembly at one or several points through one or several outlet nozzles. Also the hot reaction mixture can be ejected from said downhole assembly at one or several points through one or several outlet nozzles. The ejection can e.g. be punctiform or slot-like.

The downhole assembly can be designed stagnant or rotatable, e.g. rotatable about a central axis of the borehole at the location of the downhole assembly or the downhole drilling assembly itself. In a preferred embodiment the downhole assembly comprises a lower part which is rotatable coupled to an upper part of the downhole assembly. The lower part is rotatable about the central axis of the downhole assembly or of the lower part itself, which preferably correspond to the central axis of the borehole at the location of the downhole assembly in the borehole.

The downhole assembly can further comprise a downhole drive, e.g. a motor. The drive can be driven by the momentum of the drilling fluid and/or of the reactants and/or of the hot reaction mixture or by electricity. The drive is designed to rotate the lower part of the downhole assembly or the downhole assembly. Electric power ca be provided to the downhole assembly, e.g. by cables.

The rotating (lower) part of the downhole assembly can comprise first outlet nozzles for the hot reaction mixture and second outlet nozzles for the drilling fluid, wherein the first and second outlet nozzles are arranged alternately and circumferentially along the rotation direction to provide alternating heating and cooling conditions to the rock surface, thus inducing enhanced temperature gradients within upper rock layers. The lower part of the downhole assembly can have a bottom side as described above.

In a further development of the invention a mechanical drilling unit is additionally coupled to the downhole assembly in order to use a combination of the exothermic reaction (thermal fragmentation) and a mechanical drilling acting contemporaneously or alternately in order to excavate a borehole. The mechanical drilling action can be rotary-based. The mechanical drilling unit can be a roller bit. The mechanical drilling unit can be driven by a downhole motor.

The mechanical drilling unit can be located at an upper part of the downhole assembly and can be used to ream out a pilot hole drilled by said exothermic reaction (thermal fragmentation). In this case the mechanical drilling unit can be designed as an annular device. The exothermic reaction preferably is processed at the bottom of the downhole assembly in this case.

The mechanical drilling unit can also be designed to drill a pilot hole. For this, the mechanical drilling unit is located at the bottom of the downhole assembly. The hole size is enlarged in diameter by a flow of said hot reaction mixture directed laterally to the rock surface in an upper part of the downhole assembly.

The reactants can comprise a fuel and an oxidant, e.g. oxygen. The reactants, i.e. the fuel and/or the oxidant can be in a gaseous, liquid or even partly in the solid state, e.g. when transferred to the mixing and/or reaction zone.

The exothermic reaction forms a hydrothermal flame which directly burns in the aqueous environment of the pressurized drilling fluid and is directed towards the rock surface. The fuel can e.g. be methanol, ethanol, propanol, natural gas or diesel. The oxygen can e.g. be supplied in the form of compressed air or oxygen.

Downhole separation of the required fluid streams during operation by means of separation units (e.g. hydro-clones) is possible as well. Thus several mixtures out of drilling fluid, reactants and functional additives and combinations thereof can be separated downhole. Thus less feeding lines are required for the supply of the downhole assembly.

A hydrothermal flame corresponds to an exothermic combustion process of at least two reactants (fuel and oxidant) which directly takes place in an aqueous environment. The preferable operating conditions regarding stability and controllability of such a flame are in a supercritical water environment at temperatures above 374° C. and pressures above 221 bar.

If the critical pressure (221 bar) and the critical temperature of water (374° C.) are exceeded, then a supercritical aqueous environment is achieved. Whereas water is polar in its liquid state, it gets much less polar in its supercritical state becoming a good solvent for non-polar compounds and gases. One main characteristic of such single-phase mixtures is the lack of interfaces normally present in gas-liquid and liquid-liquid mixtures and therefore the absence of interfacial mass transfer limitations dramatically improve reaction conditions.

It is possible to control and adapt momentum (kinetic energy) and temperature of the hot jet impinging on the rock surface. The hot jet consists of the hot reaction mixture. In order to control the heat flux to the rock, drilling fluid can be added to at least one of the reactants, preferably to e.g. a liquid fuel, before entering the mixing zone. The drilling fluid can also be added directly to the mixing and/or reaction zone.

Hydrothermal flames or other exothermic chemical reactions can be ignited by spark ignition, by a glow wire or by autoignition after preheating the reactants, e.g. the fuel and/or oxidant up to their self-ignition temperature. The exothermic chemical reaction (hydrothermal flame) can be ignited and supported by a solid catalyst which favors the reaction (combustion). In a preferred development of the ignition process, the hydrothermal flame is ignited and supported by a smaller pilot flame which is located upstream with respect to said hydrothermal flame used for thermal rock fragmentation. The pilot flame also burns in a subcritical, critical or supercritical environment of water.

To establish a pilot flame, preferably a portion of the reactants, particularly of the fuel and oxidant, is heated up beyond self-ignition temperature or is ignited by spark ignition (or by a glow wire) and is used to form said pilot flame in the mixing zone of said downhole assembly. For this, means can be provided in the downhole assembly to branch off reactants from the feeding lines or the mixing zone.

The downhole drilling assembly can further comprise a preheating unit to preheat said reactants before, during and/or after mixing.

The downhole drilling assembly can comprise one or more lines, e.g. cable, for the supply of electric energy to a drive, e.g. a motor, a glow wire, a spark ignition unit or a preheating unit in the downhole assembly. An up hole electricity supply can be provided to feed the downhole drilling assembly with electrical energy.

The downhole drilling assembly is preferably adapted to be connected to the drill string of a drill rig, e.g. a conventional drill rig. The downhole drilling assembly can thereby replace a conventional mechanical drill bit in the borehole, e.g. at the bottom. For this, the downhole drilling assembly contains connecting means to connect the downhole drilling assembly to the drill string. The connecting means are preferably standardized, so that conventional mechanical or other conventional downhole drilling devices can be exchanged by a downhole drilling assembly according to the invention, without or slightly modifying the drill string at the connecting points.

The downhole drilling assembly is particularly adapted to be connected to the drill string interior of a drill rig containing separate conduits for at least two reactants and the drilling fluid. For this, the downhole drilling assembly contains connecting means to connect the downhole drilling assembly to the drill string and to connect the conduits for the drilling fluid and for the reactants to corresponding conduits in or on the drill string. If an electrical line is provided, then connecting means are provided in the downhole assembly to connect the electrical lines between the downhole drilling assembly and the drill string.

The drilling fluid is preferably fed through the drill string interior. Separate conduits for said reactants can run in an annular region between a borehole wall and the drill string. Furthermore an electric line can run in the annular region for electricity supply.

According to another embodiment of the invention with respect to the connection of the downhole drilling assembly, the downhole drilling assembly is adapted to be connected to a flexible pipe containing separated conduits for said reactants and said drilling fluid, and if provided, is adapted to be connected to an electric line for electricity supply of said down hole assembly, the electric line being run through the flexible pipe. For this, the downhole drilling assembly contains connecting means to connect the downhole drilling assembly to flexible pipe and to connect the conduits for the drilling fluid and for the reactants and, if provided, the lines for the electricity to the corresponding conduits or lines in the flexible pipe. Also here, the connecting means are preferably standardized as described above. When functional additives are needed downhole, at least one additional conduit is required inside the flexible pipe.

The downhole drilling assembly and/or the flexible pipe can be equipped with stabilizers to stabilize the downhole drilling assembly in the borehole.

The downhole drilling assembly can contain an annular slot at the bottom side to emit a stream of hot reaction mixture uniformly around an annulus. Further a central nozzle can be provided to eject the drilling fluid. The arrangement can also be vice versa: one central outlet nozzle can be provided to emit the stream of hot reaction mixture. An annular nozzle is provided around the central outlet nozzle to eject the drilling fluid.

In another embodiment with respect to the nozzle arrangement, a plurality of outlet nozzles are arranged circumferentially around the central axis of the downhole assembly, of the lower part or of the drilling hole at the location of the downhole assembly to emit streams of hot reaction mixture. A central nozzle can be provided to eject the drilling fluid. Also here, the arrangement can be vice versa: one central outlet nozzle can be provided to emit the stream of hot reaction mixture. A plurality of nozzles is provided around the central outlet nozzle to eject the drilling fluid.

As already mentioned, the downhole drilling assembly or a part of it, particularly a lower part of the downhole drilling assembly, is rotatable designed. To rotate the downhole assembly or said part of it, the downhole drilling assembly preferably comprises a drive, e.g. a motor. The drive is operable by electricity or by converting flow energy of the drilling fluid and/or the reactants and/or the hot reaction mixture into rotational movement of the downhole drilling assembly or the said part of it.

At least some of the outlet nozzles for the drilling fluid and/or the hot reaction mixture are arranged on the rotatable part of the downhole drilling assembly. In a specific embodiment of the invention a plurality of outlet nozzles, i.e. at least two, for the hot reaction mixture and the drilling fluid are arranged circumferentially around the axis of rotation and in an alternating manner in order to induce enhanced temperature gradients (alternating heating and cooling) within the rock surface layer whilst rotation of said downhole drilling assembly or said part of it.

According to another embodiment of the downhole drilling assembly with a rotatable part, one outlet nozzle for the stream of hot reaction mixture, and one outlet nozzle for the drilling fluid are arranged symmetrically and opposite to each other at the bottom side of the downhole drilling assembly in order to realize alternating heating and cooling conditions on the rock surface. The two nozzles can be swiveled, e.g. each under an angle of more than 0° and preferable of about 90°, in order to provide uniform heat flux to the whole surface of the treated rock.

The downhole assembly contains means to receive the reactants, e.g. a (chemical) fuel and an oxidant, and means to mix the reactants in the mixing zone of the downhole drilling assembly to form a hydrothermal flame burning in an aqueous environment between said mixing zone and the rock surface. The mixing zone is established in a mixing chamber in or at the downhole drilling assembly. Feeding lines of the reactants empty into the mixing chamber. The mixing chamber can be a closed or at least partly open chamber. At least one outlet nozzle, preferably a plurality of outlet nozzles, is/are connected to the mixing chamber, in order to eject the hot reaction mixture out of the mixing chamber into the space between the downhole drilling assembly and the rock surface.

The downhole drilling assembly can contain means to add drilling fluid to at least one of the reactants, particularly to a fuel, before entering the mixing zone. The addition of drilling fluid (e.g. to the fuel) can also take place up hole. Alternatively or additionally means can be provided to directly add drilling fluid to the mixing and/or reaction zone of the downhole assembly. Hence it is possible to control momentum (kinetic energy) and temperature of the hot jet impinging on the rock surface. The jet consists of the hot reaction mixture. The aim of this feature is actually to control the heat flux to the rock and the rock surface temperature during the spallation drilling process. The means can comprise feeding lines for drilling fluid, which empty at least partly into the feeding lines of the reactants and/or into the mixing zone and/or reaction zone, particularly into the mixing chamber.

The downhole drilling assembly can contain a coaxial burner with coaxial streams of said reactants, e.g. fuel and oxidant, for building the mixing zone. By using a coaxial burner a diffusion-type, turbulent hydrothermal flame can be formed.

According to another embodiment of the invention with respect to the building of the mixing zone the downhole drilling assembly contains a radial burner for radially dispersing one reactant, e.g. in form of fuel streams, into a second reactant, e.g. in form of oxidant streams, for building a mixing zone and forming a hydrothermal flame.

According to third embodiment of the invention with respect to the building of the mixing zone the downhole drilling assembly contains an annular slot burner for mixing two annular streams of a first reactant, e.g. an oxidant, with one central, annular stream of a second reactant, e.g. a fuel, in between.

As already mentioned a mechanical drilling device is coupled to said downhole assembly in order to use a combination of said exothermic reaction and mechanical drilling acting alternately or contemporaneously in order to excavate a borehole. The mechanical drilling device can be a conventional drilling device.

The distribution of drilling fluid and/or additives inside and outside the downhole assembly can be realized via so-called transpiring walls. Drilling fluid (e.g. water) and/or additives are able to penetrate through the pores of such a wall material into the space (volume) where the presence of the fluid is needed in order to support the drilling operation or protect the downhole assembly from corrosion. The surface of such transpiring walls inside and/or outside the downhole assembly, however, are constantly in direct contact with corrosive species, abrasive particles (rock cuttings) and high heat loads by the exothermic reaction. The liquid film formed on the surfaces of the transpiring walls by the penetration of fluid through helps to protect the walls from the harsh environment downhole and therefore reduce corrosion significantly. Parts of the downhole assembly suffering from corrosion (e.g. outlet nozzle, mixing chamber, outer housing, etc.) could be realized with transpiring walls.

The method is proposed to perform thermal spallation drilling in the aqueous environment of deep boreholes filled with water-based drilling fluids (water, water and functional additives, water-based drilling mud, etc.). Strongly exothermic reactions, such as combustion reactions, are established in the aqueous environment and provide the high heat loads required to thermally fragment the rock. Owing to the drilling fluid column in the borehole hydrostatic pressures in depths around 2.5 km overcome the critical pressure of pure water (i.d. 221 bar). Among other reactions this offers the possibility to benefit from so-called hydrothermal flames, a combustion process which preferably takes place in a supercritical water environment (>=221 bar, >=374° C.). Having the major part of the hot reaction zone and therefore the maximum heat release of the flame directly at or near the rock surface and not only inside a combustion chamber allows for high temperatures and high heat fluxes to be transferred from the flame jet to the upper rock layers. The design of the thermal spallation drilling downhole assembly further makes use of different nozzles providing streams of hot reaction mixture and cool streams of drilling fluid to enhance thermal gradients within the upper rock layer by systematic and alternating heating and cooling of the rock surface. Any increase of thermal gradients within the rock surface layer is highly beneficial to the process of thermal fragmentation and results in a higher penetration rate in the rock formation.

It turned out that a hydrothermal flame burns stably within a wide range of operation conditions and withstands even harsh conditions, such as intensive pressure oscillations and fast and abrupt changes in fuel or oxidant mass flow rates.

The present invention using preferably hydrothermal flames can be applied in an aqueous environment for deep heat mining, where boreholes of several kilometers depth are needed to access natural geothermal energy (heat) resources and finally produce electric energy in power plants. A fundamental idea underlying the present patent was the use of hydrothermal flames as heat source of a spallation drilling downhole assembly having the main reaction zone of the flame located directly in an aqueous environment of a water based drilling fluid in a borehole. The proposed drilling method automatically benefits from the liquid column of the drilling fluid inside the borehole, which beyond certain depths naturally generates hydrostatic pressures exceeding the critical pressure value of pure water (221 bar) downhole, thus providing excellent conditions for the operation of hydrothermal flames. Once the flame is ignited downhole, also temperatures exceed the critical value of water (374° C.) in the flame zone.

The present invention can be applied for drilling vertical and directional boreholes by means of thermal rock fragmentation. The method according to the invention preferentially works in hard rock formations beyond about 2.5 km depth using highly exothermic reactions establishing in the pressurized, aqueous environment of a water-based drilling fluid above the critical pressure of water (221 bar). The present invention works contact-free, means there is no direct physical contact in between downhole assembly and rock being drilled. Thus between the ejection nozzles and the rock surface there is preferably a space filled with hot reaction mixture and/or drilling fluid.

Supercritical Water as Medium for Highly Exothermic Reactions

The present invention, though basically proposing a totally new drilling mechanism with respect to mechanical rotary drilling concepts, should nevertheless benefit from the know-how of the highly advanced conventional drilling technologies: Boundary conditions such as the use of drilling fluids to flush the borehole or the operation of wellbore completion should therefore be borrowed from conventional drilling. This is the reason why the use of a water-based drilling fluid (water, water plus functional additives, water-based drilling mud) is suggested. Having a drilling fluid circulating in the borehole the hydrostatic pressure at the bottom of the hole is defined by the height and the density of the fluid column in the borehole above. Beyond certain depths (about 2.5 km, depending of the drilling fluid used) the hydrostatic pressure downhole exceeds the supercritical pressure of water (221 bar). Although supercritical temperatures (>374° C.) are generally not reached in these depths, the supercritical pressure conditions provide an excellent environment for reactions such as exothermic oxidations. The thermo physical properties change significantly going from sub- to supercritical conditions (see FIG. 1). Whereas water is polar in its liquid state, it gets much less polar in its supercritical state becoming a good solvent for non-polar compounds and gases, such as oxygen, nitrogen or carbon dioxide. One main characteristic of such single-phase mixtures is the lack of interfaces normally present in gas-liquid mixtures. Using for instance an oxidation in supercritical water the absence of interfacial mass transfer limitations dramatically enhances reaction conditions. This even allows for flames to burn stably in supercritical water. These so-called hydrothermal flames or other strongly exothermic reactions can be used downhole in several kilometers depths, where preferably supercritical pressure conditions of water for such reactions are naturally given.

Hydrothermal flames in aqueous conditions offer new possibilities for thermal spallation drilling. It was stated earlier that thermal spallation drilling is typically a low density operation, where the hole is substantially filled with combustion gases, since stable operation of flames in water was considered too delicate. Out of this concern, ideas arose to use water jets instead, which are heated up in a combustion chamber and impinge onto the rock surface This would obviously enable a high-density operation (in water-filled boreholes), but on the other hand significantly decrease energy and thermal spallation efficiency, as heat is lost during water heating and generally lower temperatures are available for thermal drilling. Hydrothermal flames suggested here, representing one example of an exothermic reaction in preferable supercritical water, eliminate all these deficiencies of conventional spallation techniques by offering the possibility of both performing high density drilling operations in boreholes filled with a drilling fluid and bringing high temperatures and heat fluxes close to the rock surface, where they are needed. These properties are particularly appropriate for drilling in great depths.

Having the possibility of an exothermic reaction taking place directly in an aqueous environment of e.g. water based drilling fluid as mentioned above offers major advantages for thermal spallation drilling:

First of all water or water based drilling fluid can be used to control the momentum (kinetic energy) and temperature of the jet out of the hot reaction mixture impinging on the rock surface. For e.g. water does not participate in the chemical exothermic reaction of the reactants (reactive species) and can therefore be seen as inert component that is used as an energy carrier towards the rock surface. With this non reactive component, it is as well possible to control the flame temperature and therefore the rock surface temperature during drilling operation. Fusion of rock in the spallation drilling process has to be prevented that thermal fragmentation occurs. In case of fusion, the rock behaves ductile and not brittle when thermal stresses are induced. Furthermore, the momentum of the hot jet influences the (convective) heat transfer from the impinging hot jet towards the rock surface. A higher kinetic energy of the hot jet is additionally helpful to flush away the formed rock fragments (spalls) out of the spallation zone during a heating period.

Figure 2:
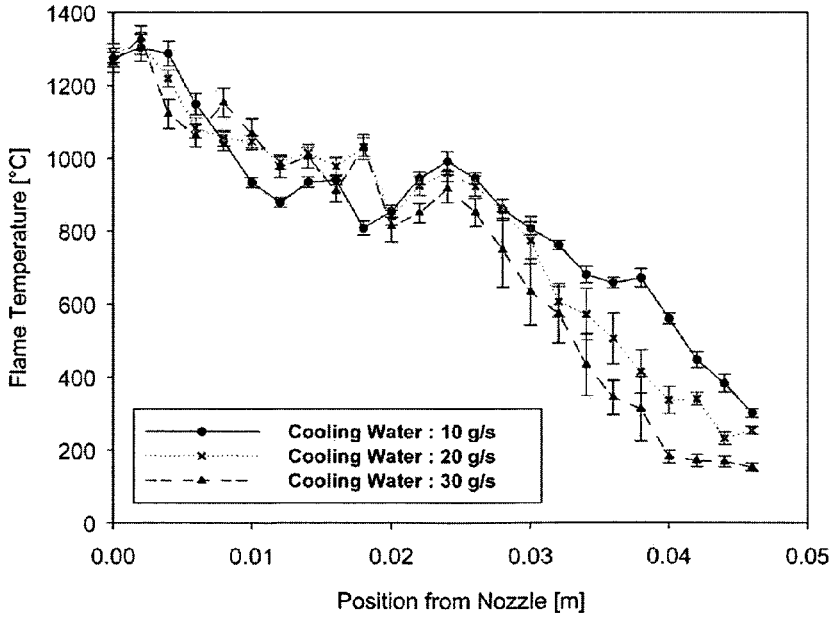

The mixing zone begins where at least two reactants (the reactive species) get in contact with each other. When the reactants are mixed, the chemical exothermic reactions can be established according to the local conditions. Thus the mixing and reaction zone can overlap or can be congruent. Therefore, the reaction zone can be shifted in between the mixing zone of the downhole assembly and the rock surface, depending on the used operating conditions and according to the local requirements to spall the rock. Thus the high temperature reaction zone can be brought closely to the rock surface by continuously directing a stream of hot reaction mixture to the rock surface. If using hydrothermal flames for instance in hard rock formations it is of strong advantage to have the hot reaction zone of the flame jet itself impinging on the rock surface and not just the hot combustion gases out of a downhole combustion chamber. Experimental results underline this necessity in terms of axial flame temperatures as illustrated in FIG. 2.

Enhancing Thermal Gradients by Systematic Cooling and Heating

The driving force of thermal rock fragmentation is the temperature gradient (in between the rock surface temperature and the bulk temperature of the rock formation) in the upper rock layer inducing mechanical stresses due to thermal expansion and finally causing material failure. This thermal gradient is generated by increasing the rock surface temperature by an impinging hot jet above that of the rock bulk temperature, which is somewhere between 10° C. and 300° C. in most relevant depths. For each rock type a characteristic value for the temperature gradient has to be reached in order to spall the rock. After long thermal drilling operations the heat provided by the reaction not only reaches the upper surface layer of the rock, which is suddenly ejected from the bulk, but it also diffuses gradually into the untreated rock of the formation. As drilling proceeds, an increasing portion of the rock underneath is heated up and temperature gradients between the rock surface and the rock layers beneath permanently decrease. Since temperature gradients in the rock surface layer are the driving force for the spallation drilling process, drilling performance gradually deteriorates by this mechanism. This can even lead to the necessity of stopping the drilling process and let the rock formation cool down for a while.

In a preferred embodiment, the present invention suggests a method to avoid this problem: A systematic interaction between cooling stream (drilling fluid) and heating stream (hot reaction mixture) guarantees periodic cooling of the rock surface and constantly high thermal gradients within the surface of the rock. Depending on whether a rotary or non-rotary downhole assembly is used two types of methods are suggested: For a rotary drill head (first method) an alternating and circumferential array of nozzles for rock cooling (drilling fluid) and rock heating (hot reaction mixture) is provided at the bottom side of the drill head. Having this drilling device rotating along its axis the rock is locally heated and cooled in turns. For a non-rotary drill head on the other side, the heating mass flow (hot reaction mixture) and/or the cooling mass flow (drilling fluid) is subject to constant oscillations (over time) resulting in temporally varying cooling and heating conditions for the rock beneath (second method). The second method is also applicable for rotary drill heads in addition or alternative to the first method.

In either of the cases gradual heat diffusion inside the rock formation and consequent decrease of thermal gradients within the rock surface layer can be avoided. Apart from making the spallation process more efficient, this concept of cooling and heating the rock also has two additional positive side effects: It helps on the one hand preventing undesired fusion of rock material, since the additional cooling keeps rock temperatures generally low. This is particularly important for rock types with low melting points, which tend to fuse during spallation drilling operation. On the other hand temperatures of the rock can more easily be kept below the brittle-to-ductile limit of the rock. This is an important factor in thermal spallation drilling: Once temperatures of the rock exceed this limit, spallation drilling is impeded, because thermally induced stresses can be relaxed by deformations and fragmentation no longer occurs.

This newly developed concept for a spallation drilling process and downhole assembly is appropriate in an aqueous environment, especially below 2.5 kilometers depth. Suitable operating conditions are in principle at sub-, critical and supercritical conditions of water. The concept opens the possibility for vertical and directional drilling.

The most important application of this technology is actually deep heat mining for the production of electricity out of geothermal energy. For the production of electricity, the wells may sometimes have to reach a depth of 10 km and more in order to make the geothermal energy reservoirs accessible. Steam out of geothermal reservoirs is expanded in turbines to produce electric energy in geothermal power plants.

The first possible approach is the direct extraction of supercritical water out of the underground. Therefore, high pressurized and hot water out of a water reservoir in the formation in great depth is used as energy source.

Circular flow of water in closed systems is another possible method. The closed loop consists out of wells, the underground heat exchangers and the power plant on the earth surface. Therefore, at least two lines are needed, the injection line and the production line. Cold water from the power plant is pumped into the injection line and passes the downhole heat exchanger. The heat exchange in between hot rock and cold water can be realized in permeable cracks in the formation connecting the two lines with each other. Furthermore the downhole heat exchanger can be engineered with horizontal pipes closing the loop downhole. Hot water out of the production line is finally used to generate electricity and heat.

DETAILED DESCRIPTION OF PREFERRED EMBODIMENTS

Figures 3A, 3B, 3C:
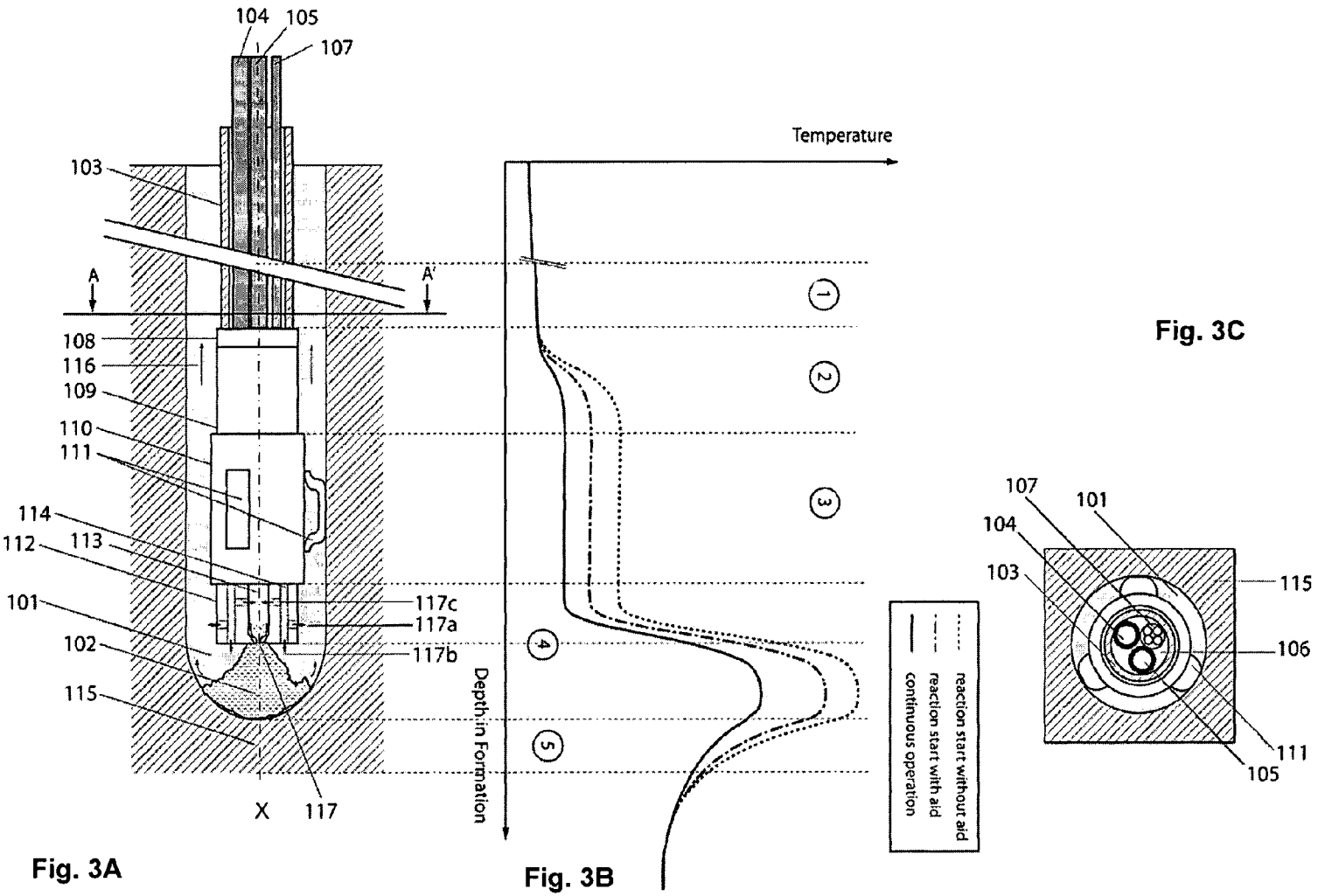
Figure 4:
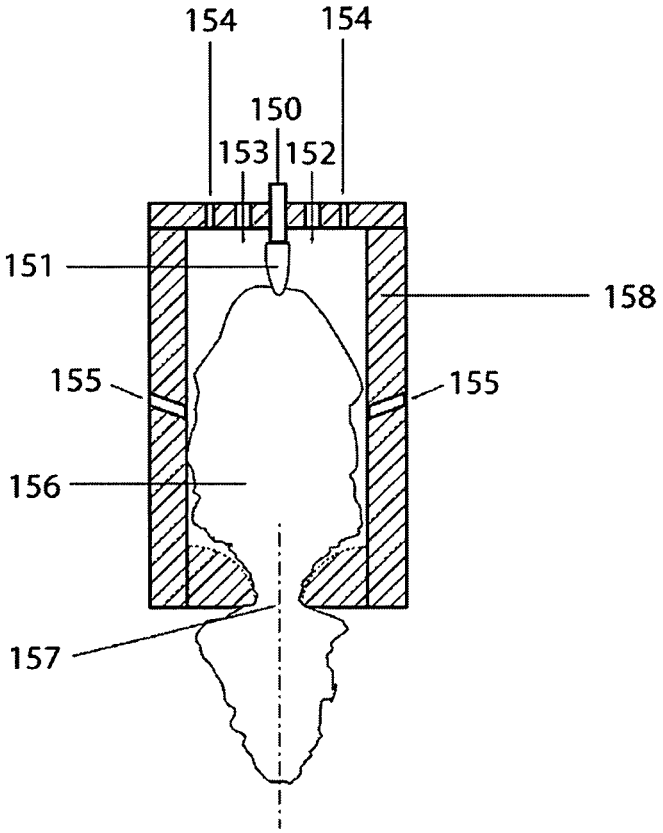
Figure 5:
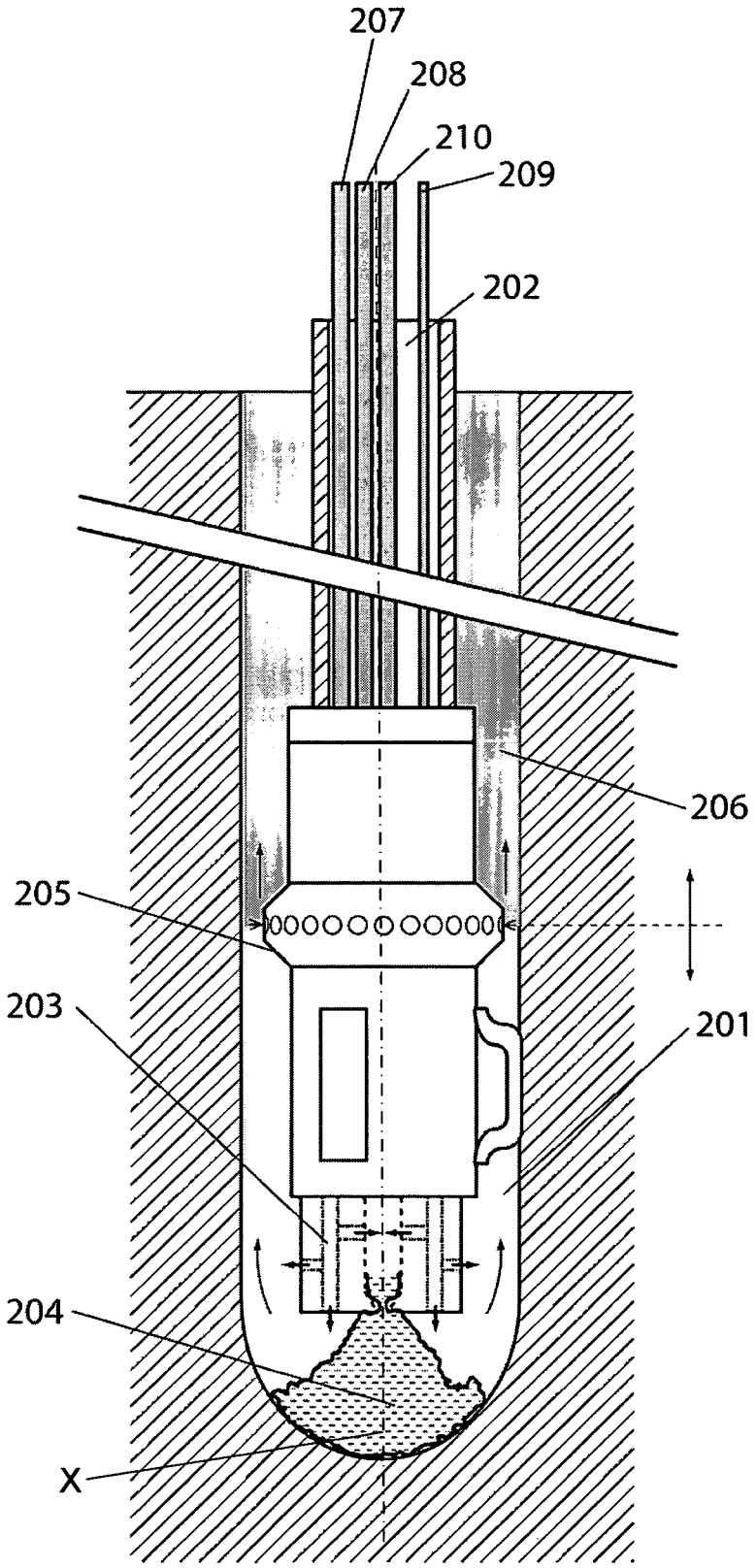
Figure 7A:
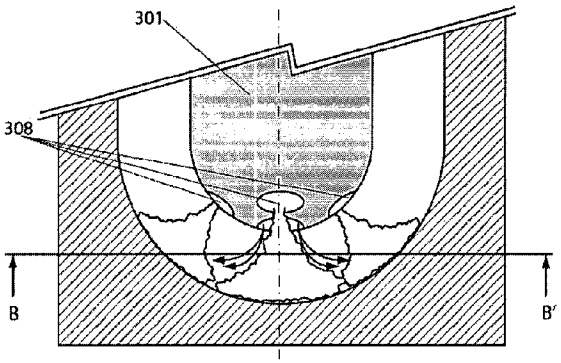
Figure 7B:
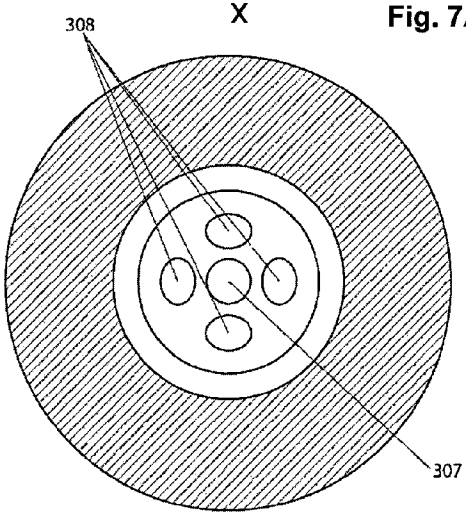
Figure 6:
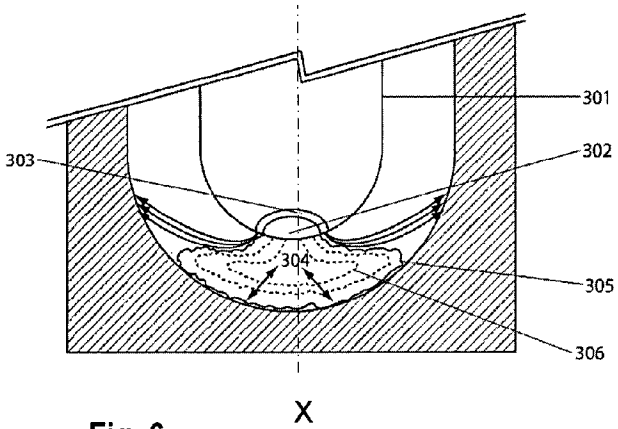
Figure 8A:
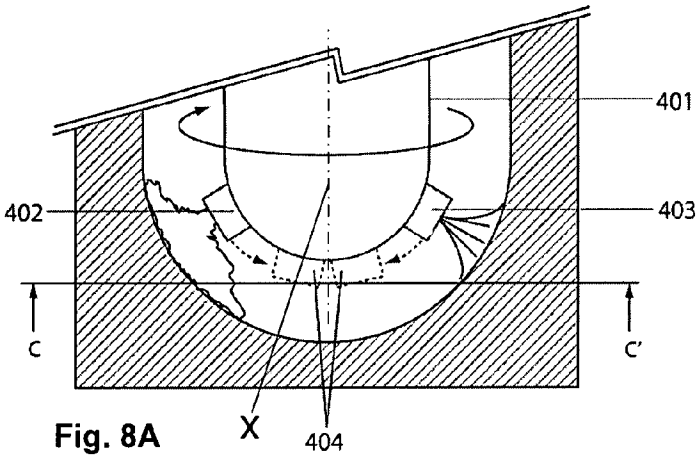
Figure 8B:
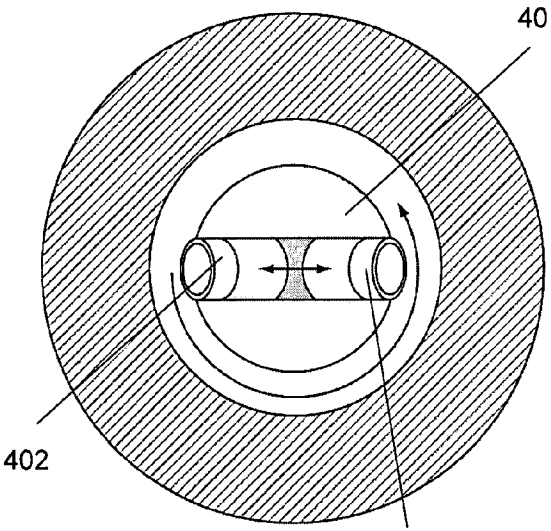
Figure 8C:
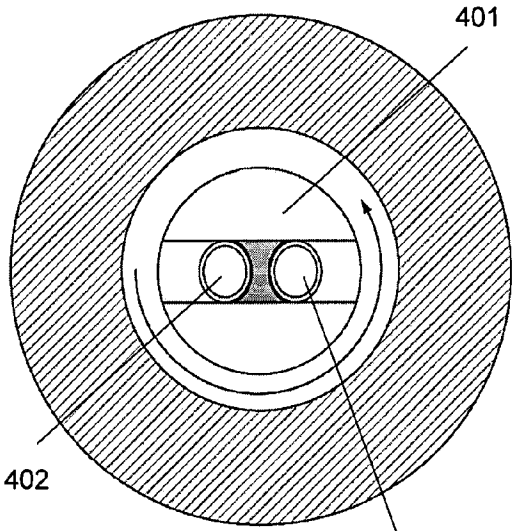
Figure 9A:
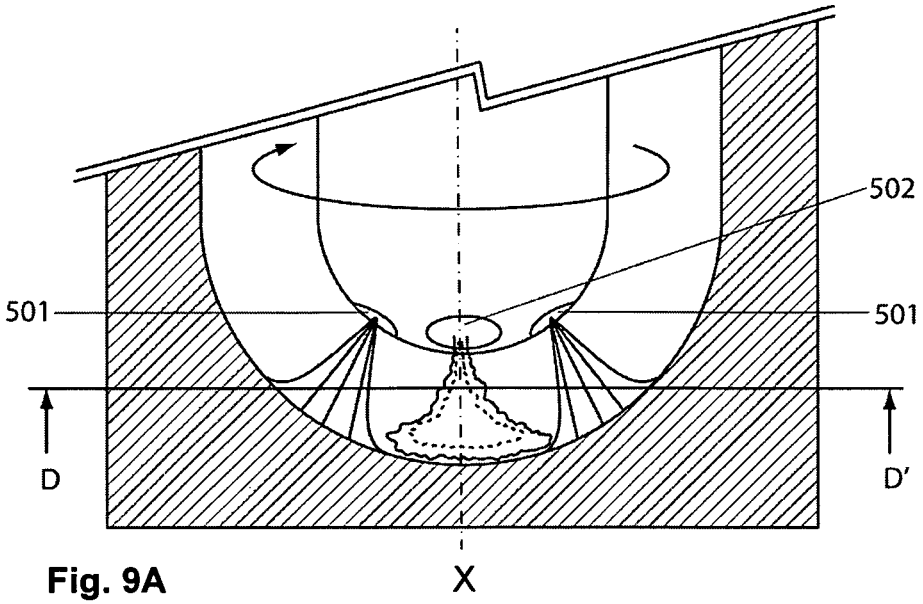
Figure 9B:
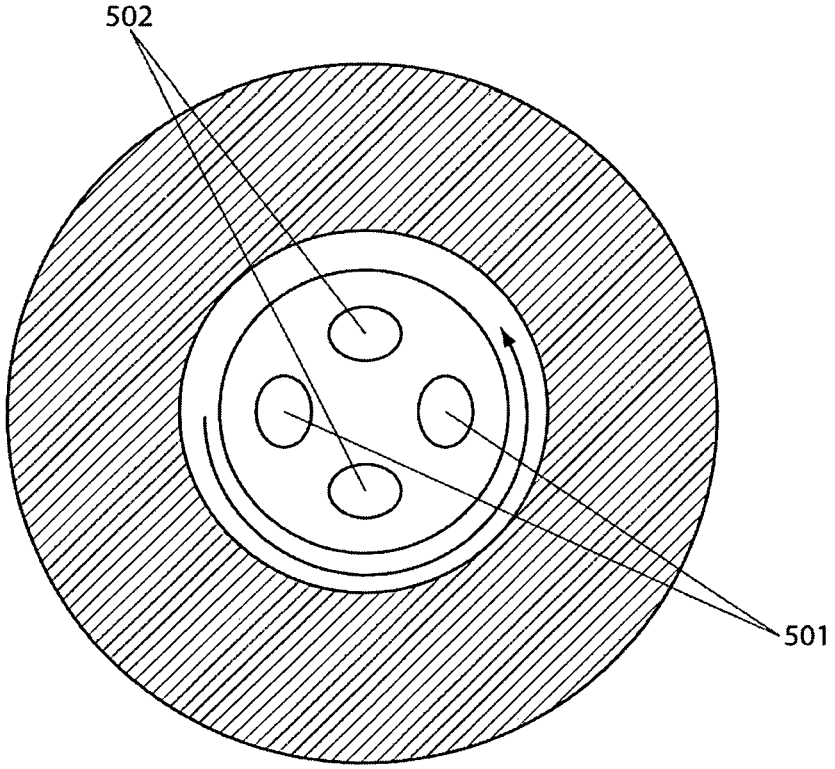
Figure 11B:
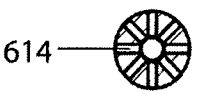
Figure 11A:
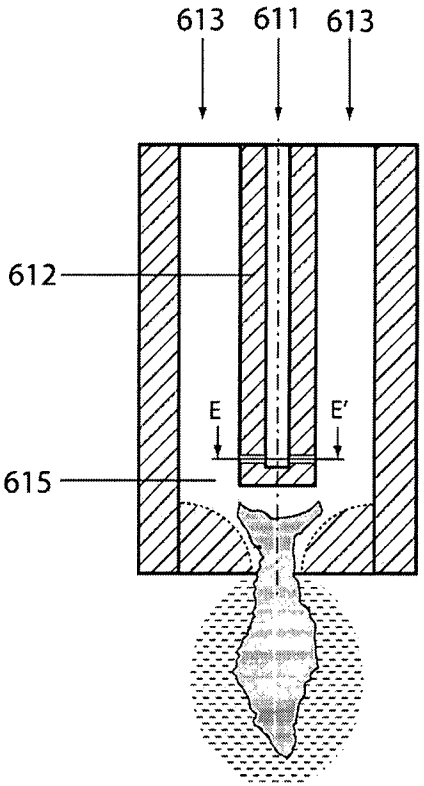
Figure 10:
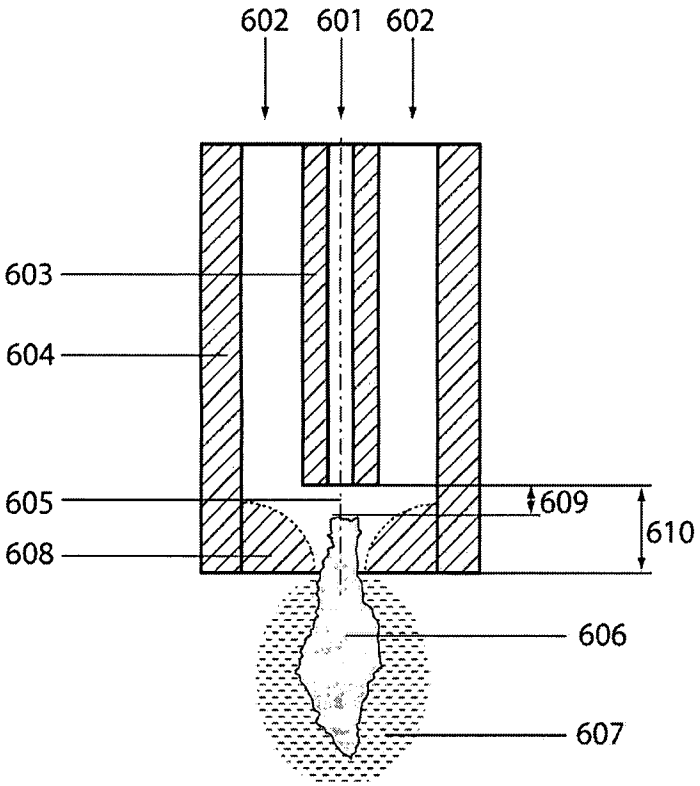
Figure 13:
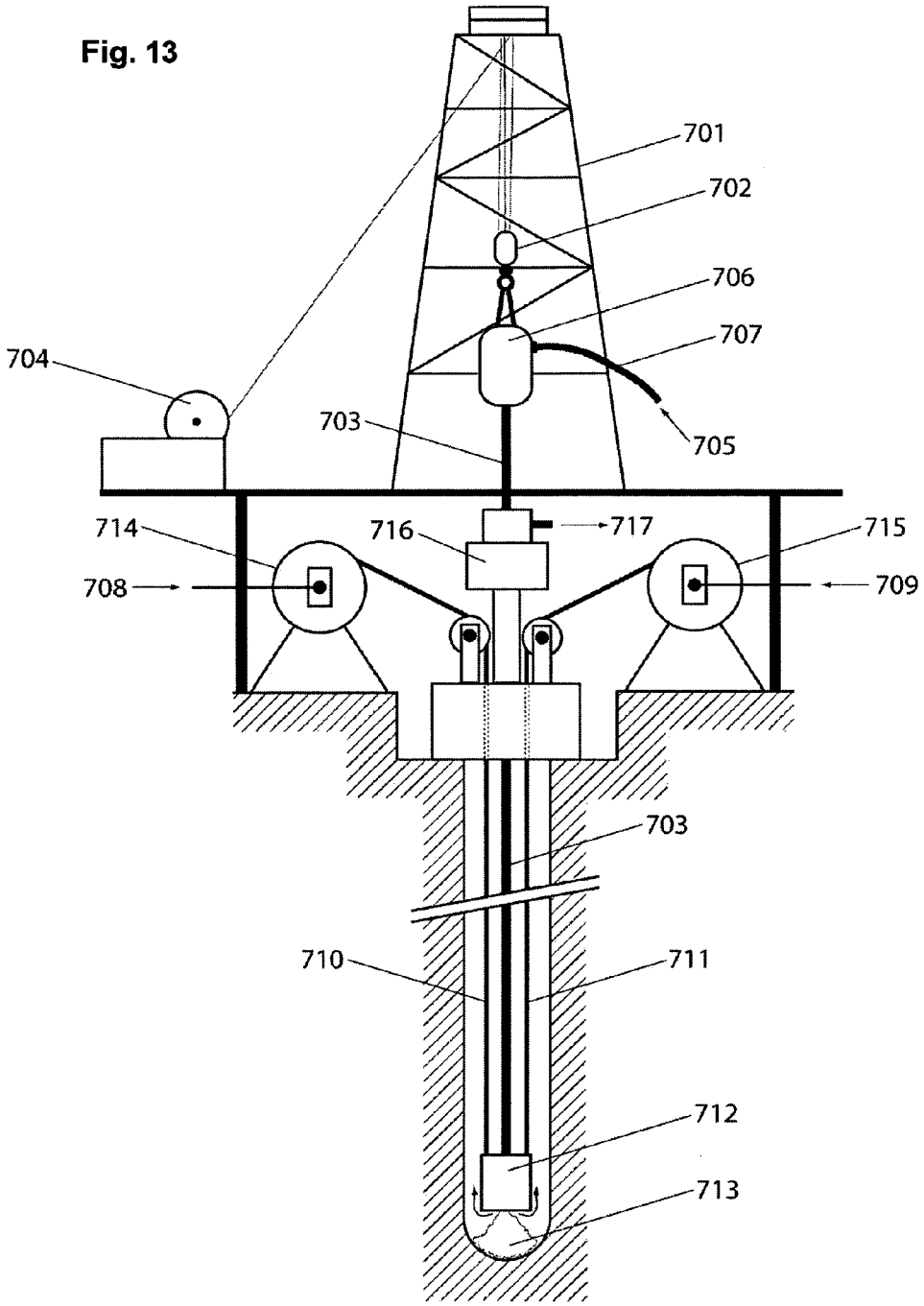
Figure 14:
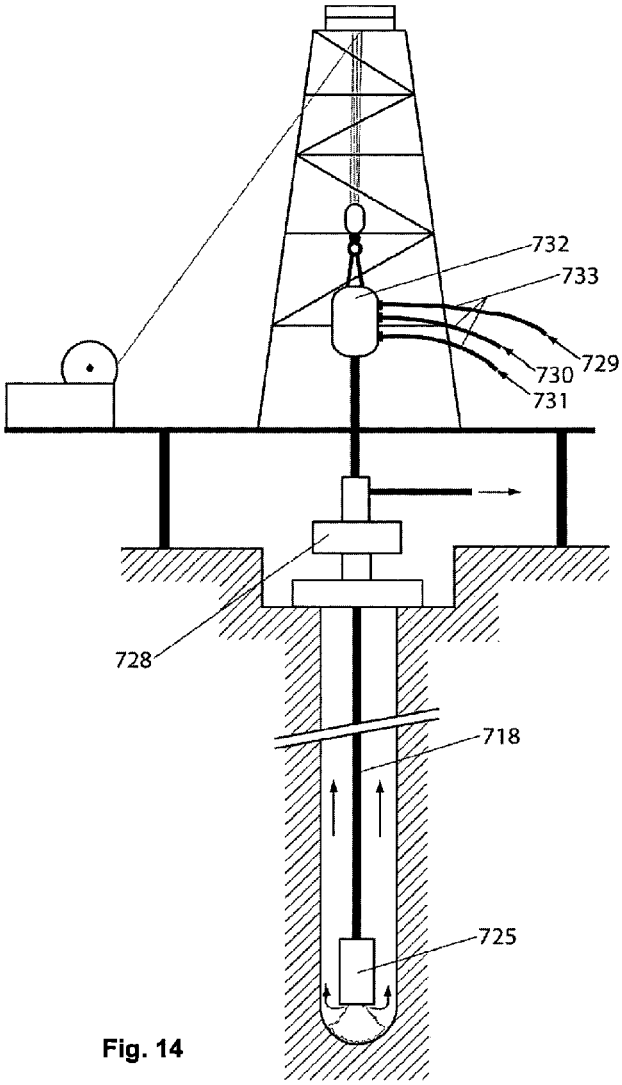
Figure 15A:
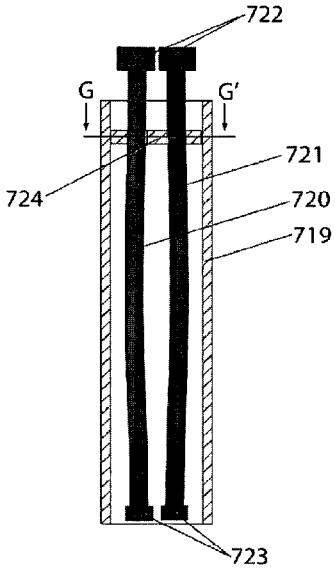
Figure 15B:
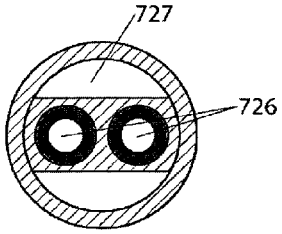
Figure 16:
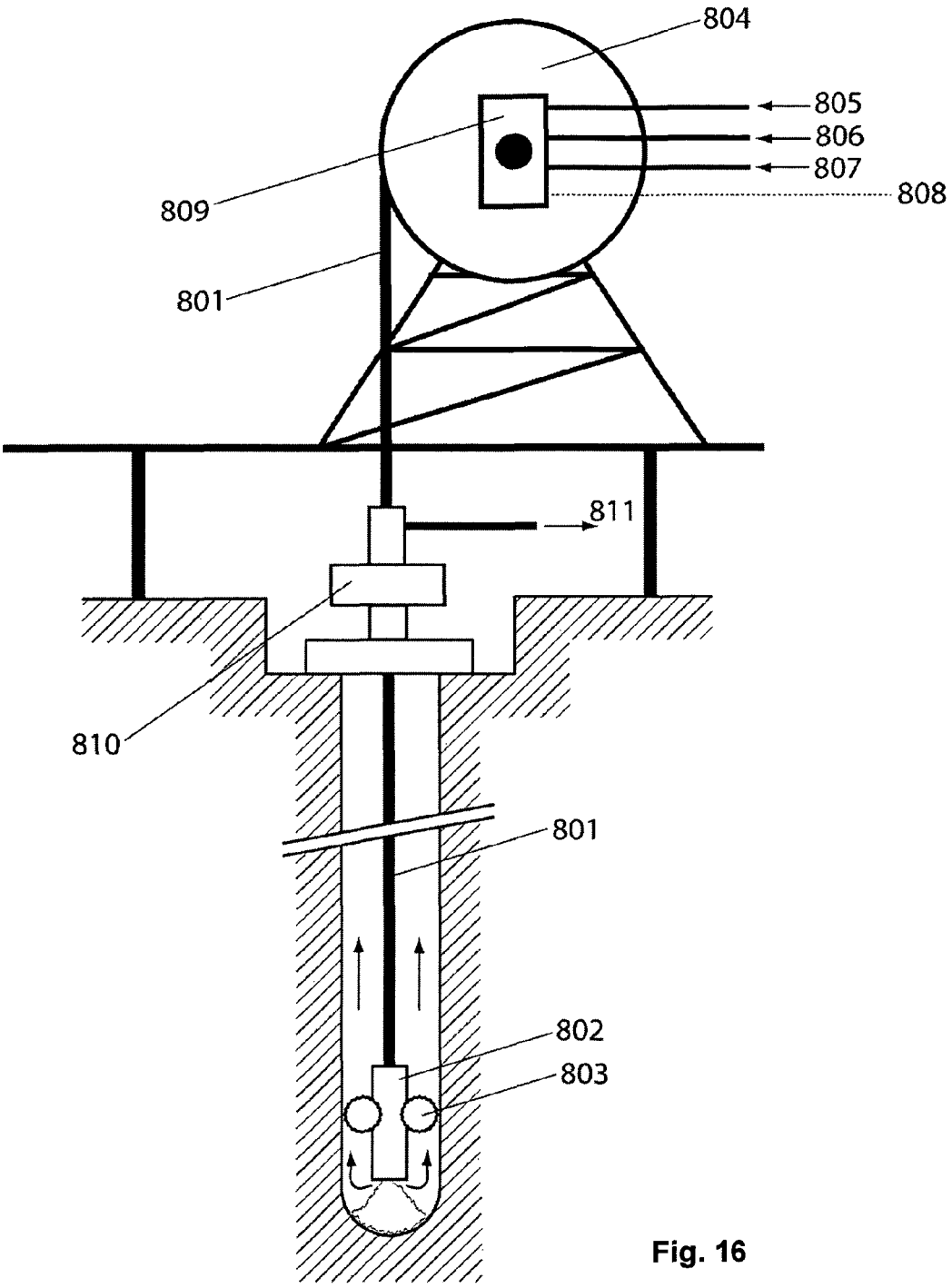

Exemplary embodiments of the device and detailed explanations of the method according to the invention are described in detail in connection with the following figures. The figures describe:

FIG. 1: the development of thermo-physical properties of water across the critical point at a pressure of 250 bar;

FIG. 2: temperature profiles of a quenched, hydrothermal flame in supercritical water at different cooling water mass flows surrounding the flame;

FIG. 3A: an embodiment of a downhole drilling assembly;

FIG. 3B: a temperature profile of the reactants (e.g. fuel and oxidant), reaction products and rock along the axis of the borehole;

FIG. 3C: a cross-section A-A' of the downhole drilling assembly according to FIG. 3A;

FIG. 4: a detailed view of the mixing chamber according to the downhole drilling assembly of FIG. 3A with pilot flame;

FIG. 5: a further embodiment of a downhole drilling assembly including additional injection points of functional drilling fluid additives;

FIG. 6: an embodiment of the drilling head of a non-rotating downhole drilling assembly with outlet nozzles;

FIG. 7A: a further embodiment of the drilling head of a non-rotating downhole drilling assembly with outlet nozzles;

FIG. 7B: a cross-section B-B' of the downhole drilling assembly according to FIG. 7A;

FIG. 8A: a further embodiment of the drilling head of a rotating downhole drilling assembly with outlet nozzles;

FIG. 8B: a cross-section C-C' of the downhole drilling assembly according to FIG. 8A;

FIG. 8C: a cross-section C-C' of the downhole drilling assembly according to FIG. 8A;

FIG. 9A: a further embodiment of the drilling head of a rotating downhole drilling assembly with outlet nozzles;

FIG. 9B: a cross-section D-D' of the downhole drilling assembly according to FIG. 9A;

FIG. 10: an embodiment of a mixing chamber of a downhole drilling assembly;

FIG. 11A: a further embodiment of a mixing chamber of a downhole drilling assembly;

FIG. 11B: a cross-section E-E' of the mixing chamber according to FIG. 11A;

FIG. 12A: a view from the bottom side of a further embodiment of a mixing chamber of a downhole drilling assembly;

FIG. 12B: a cross-section F-F of the mixing chamber according to FIG. 12A;

FIG. 13: a first embodiment of a drilling rig;

FIG. 14: a second embodiment of a drilling rig;

FIG. 15A: a drilling string element according the second embodiment in FIG. 14;

FIG. 15B: a cross-section G-G' of the drilling string element according to FIG. 15A;

FIG. 16: a third embodiment of a drilling rig.

FIG. 2: Three axial temperature profiles of a continuous hydrothermal diffusion flame burning in water at a pressure of 250 bar are shown. Preheated ethanol is burnt with preheated oxygen in a cylindrical reactor under an oxygen excess ratio of 1.5 using three different cooling water mass flows. The cooling water flows in an annulus between the flame and the reactor walls and therefore is in direct contact with the hot reaction zone. The length of the flame in all experiments is about 25 mm. It can be clearly seen that temperatures dramatically drop outside the flame zone due to the cooling effect of the subcritical surrounding cooling water. The higher the mass flow of cooling water the steeper the temperature drop in the burnt products zone.

The fast cooling of the burnt products shows that the desired high temperatures and heat fluxes to induce rock failure can be achieved better by moving the reaction zone of the flame as close as possible to the rock surface. But not only the spallation process itself, but also the energy efficiency of the whole system can be improved by making the reaction zone itself impinge at least partly onto the rock surface and providing the heat, where it is actually needed. It is expected that the whole spallation drilling region in between the outlet of the downhole assembly and the rock surface has to be at least in a supercritical state of water (>=374° C.) to limit the heat loss and cooling down of the jet on the way to the rock surface during the spallation period. Other systems, where a non-reacting jet of burnt combustion gases or hot water is directed towards the rock, suffer from higher heat losses and therefore from energetic and economic inefficiencies. Moreover also the thermal spallation process itself can be slowed down or even inhibited by the generally lower temperatures in such systems.

It can be concluded that especially in the case of an exothermic reaction zone having a large boundary area shared with a surrounding liquid cooling media (e.g. water-based drilling fluid), it can be beneficial for an economic spallation process to bring the reaction zone as close as possible to the rock surface. Additionally or alternatively the overall efficiency of the spallation process can be further enhanced, if the whole region between the bottom side (comprising outlet nozzles) of the downhole assembly and the rock surface is kept at high temperatures at least above the critical temperature of water. In such a case the hot reaction mixture has no direct contact to a cold media before impinging onto the rock surface. The hot reaction mixture mixes with cooling media (e.g. water-based drilling fluid) not until it has impinged on the rock surface and transferred the necessary heat to the near-surface rock layers that are to be fragmented.

FIG. 3A schematically illustrates a downhole assembly for carrying out the proposed method of thermally fragmenting rock by using exothermic reactions. The drilling operation typically takes place in pre-drilled boreholes in depths beyond ca. 2.5 km in hard rock formations. The method proposed herein is explicitly designed as a high-density drilling operation, thus contemplating the application of state-of-the-art drilling fluids.

The borehole is substantially filled with a water-based drilling fluid 101. Downhole hydrostatic pressures in these depths exceed the critical pressure of water (221 bar) because of the drilling fluid column above. These are excellent conditions for certain exothermic reactions to establish (e.g. combustion reactions in hydrothermal flames): Once such an exothermic reaction is started downhole also temperatures within the reaction zone 102 rise above the characteristic critical temperature for water (374° C.). Serving as a reaction medium the supercritical aqueous environment provides excellent conditions for a stable and continuous operation of some exothermic reactions as discussed above.

Whereas water is polar in its liquid state, it gets much less polar in its supercritical state becoming a good solvent for non-polar compounds and gases. One main characteristic of such single-phase mixtures is the lack of interfaces normally present in gas-liquid and liquid-liquid mixtures and therefore the absence of interfacial mass transfer limitations dramatically improve reaction conditions.

The drill string casing 103 can be realized with rigid or flexible pipes and contains separate conduits for the reactants 104, 105, the drilling fluid 106 and the electricity 107. All fluid media required downhole (drilling fluid and reactants) are preferably stored in containers up hole and are constantly pumped down to the downhole drilling assembly through the corresponding conduits. They all enter the downhole assembly at the connection unit 108, which connects the conduits with the downhole assembly. In the subsequent preheating unit 109 the reactants are heated up to temperatures required to overcome the characteristic activation energy of the reaction. The preheating can be realized by electric heaters. Once the reaction is started, continuous drilling operation is enabled and heating power for preheating the reactants can be lowered significantly to a point at which the reaction still can be sustained. The preheating unit 109 is followed by a mechanical unit 110, which may contain drive means to rotate a lower part of the downhole drilling assembly. The three centralizers 111 at the outside of the unit are inflatable and can be moved vertically with respect to the downhole assembly. They stabilize the whole assembly inside the borehole and provide mechanical guidance for the vertical movement of the assembly, especially in case of a drill string 103 being realized as flexible hose. The downhole drilling assembly contains a lower part which comprises a mixing unit 112, which contains at least a part of the mixing and/or reaction zone and outlet nozzles for drilling fluid and/or the hot reaction mixture. The lower part can be rotationally coupled to the upper part of the downhole drilling assembly. The mechanical unit 110 can comprise a downhole motor converting the flow energy of the drilling fluid and/or electric energy into rotational energy of the mixing unit 112 below. Depending on whether or not the mechanical unit 110 is equipped with a downhole motor, the mixing unit 112 either rotates along its axis X or is rotary stagnant. In either case the reactants are brought together and mixed in the mixing chamber 113, which contains the mixing zone or parts of it and optionally also the reaction zone or parts of it. The drilling fluid just passes through inside separate channels 114. The mixing unit 112 can further comprise means to favour the start of the reaction at the beginning of a drilling operation: An electrical spark or an electrically heated wire brings additional activation energy into a small volume containing at least two reactants and therefore lowers the temperatures of the reactants needed to start the reaction. On the other side an appropriate solid catalyst supporting the reaction can lower the activation energy and therefore also decreases temperatures required to get the reaction started.

At the bottom side of the mixing unit 112 there is an outlet nozzle 117 for the hot reaction mixture. Corresponding outlet nozzles for the drilling fluid can be found laterally 117*a* and/or at the bottom side 117*b* of the mixing unit 112. Furthermore drilling fluid can be fed into the mixing and/or reaction zone via feeding lines 117*c*. The mass flow rate through the different nozzles 117*a*, 117*b* and 117*c* can be adapted via controllable valves or mass flow controllers.

Realizing the walls of the mixing chamber as so-called transpiring walls is another possibility to bring drilling fluid into the mixing chamber 113 and at the same time preventing the mixing chamber walls from corrosion. These transpiring walls could be made of sintered metals or ceramics allowing drilling fluid (e.g. water) to penetrate through the pores of the wall material into the mixing chamber 113. Especially salts previously well dissolved in subcritical water (e.g. drilling fluid) can precipitate in supercritical water and cause corrosion of the construction material used. The surface of such transpiring walls, however, is constantly liberated from such salt residues by the liquid film formed by the penetrating fluid. Other parts of the downhole assembly normally suffering from corrosion (e.g. outlet nozzle, outer housing, etc.) could be realized with transpiring walls as well. Transpiring walls can be thought of as a possibility for drilling fluid injection at positions where corrosion could occur.

The main part of the hot reaction zone 102, where a maximum of heat is released by the exothermic reaction, can be brought close to the rock underneath 115 to ensure the highest possible heat flux to the surrounding rock. As explained below more in detail varying heating and cooling conditions at the rock surface can have additional beneficial effects for thermal spallation drilling operation. The fluid flowing upwards in the annular region 116 between downhole assembly and borehole wall typically consists of drilling fluid, reaction products and non converted reactants and constantly lifts rock the cuttings (spalls) up to the surface, where the drilling fluid is cleaned and re-injected into the interior of drill string 106 (FIG. 3C). Apart from cutting transport and cooling, the drilling fluid also helps preventing borehole collapse, controlling the formation pressure and sealing permeable formations.

During a heating cycle the reactants R1 and R2 are e.g. at high mass flows and drilling fluid is being ejected at points 117*a*. During this cycle the major part of the fluid surrounding the rock surface being fragmented is at supercritical conditions. During a cooling cycle the reactants R1 and R2 are e.g. at low mass flows whereas the drilling fluid is being ejected at points 117*b* and/or through nozzles 117*c* (reaction goes on with small mass flows of the reactants R1 and R2 and small energy release directly in the drilling fluid) to get cool fluid ejected vertically from the downhole assembly and cool down the rock surface.

The temperature profile of FIG. 3B is divided in several sections. Section 1 shows the temperature development of the two reactants from the top of the borehole to the connection unit 108: Due to the constant, but subtle temperature increase of the rock formation with depth, also the reactants R1 and R2 can heat up naturally owing to the heat transfer from the borehole walls to the conduits 104, 105. In the preheating unit 109 (section 2) the reactants R1 and R2 are electrically heated up to a temperature required to start or sustain the reaction. Two temperature profiles are shown there: The dashed lines represent temperatures at the start of the reaction, whereas the solid line corresponds to continuous drilling operation. Starting the reaction generally requires temperatures far higher than temperatures needed to sustain the reaction during continuous operation. By lowering the heating power after reaction start the energy consumption can be reduced considerably. The above discussed means for providing additional energy to favour reaction onset (spark, pilot flame, wire) or to reduce the activation energy of the reaction (solid catalyst) can further contribute to energy savings by decreasing the required temperature at the reaction start. The temperature profile corresponding to this case is denoted "reaction start with aid".

In section 3, where the reactants pass through the mechanical unit, a small decrease in temperature can occur. To minimize this heat loss the distance between pre-heater outlets and mixing chamber 113 has to be kept as short as possible. Section 4 corresponds to the mixing/reaction zone 113/102 where the two reactants mix and finally react to products undergoing a sudden and sharp temperature increase. The high temperatures within this zone have to be brought as close as possible to the rock, whose temperature profile is shown in section 5: A sharp temperature gradient within the upper rock layer leads to high mechanical stresses in the near-surface rock layer that finally cause material failure.

The mixing chamber of FIG. 4 is described here for a reaction between a fuel and an oxidant forming a flame, but could generally be used for another exothermic reaction between two or more reactants. A small burner device 150 at the top of the mixing unit 158 according to FIG. 4 provides a small pilot flame 151 that is supported by small portions of the total fuel (optionally mixed with water) and oxidant streams. The pilot flame 151 is sustained during both heating and cooling cycles. During a heating cycle, however, the mixing unit 158 is further fed by comparably high mass flows of fuel 152 and oxidant 153. At the start of a heating cycle when the high fuel 152 and oxidant 153 mass flows are started (e.g. by means of valves) the ignition of the big reaction/combustion zone 156 is suddenly reached because of the constantly burning pilot flame 151. The hot reaction mixture is ejected through one or more nozzles 157. During a heating cycle a water-based drilling fluid or water can also be injected in the mixing unit 158 through nozzles 154 and 155 to control temperatures as well as energy and momentum transfer to the rock.

Instead of nozzles also the transpiring walls discussed above could be used to introduce drilling fluid uniformly into the mixing chamber 158. During a cooling cycle mass flows of fuel and oxidant 152, 153 are reduced or partially or totally stopped, whereas the small amounts of fuel and oxidant to sustain the pilot flame 151 are still provided. At the same time flow of water or a water-based drilling fluid through nozzles 154 and 155 is started or increased. During a cooling cycle the mixing unit 158 is mostly filled by a cold water-based drilling fluid and the big reaction/combustion zone 156 disappears. Only the small pilot flame 151 is sustained in the aqueous environment. During this period mainly cold drilling fluid is ejected through nozzle 157 and the rock is cooled. As soon as the cooling cycle comes to an end, the flow of drilling fluid into the mixing unit 158 is stopped or throttled and the fuel and oxidant flow through 152 and 153 is started or increased. The above described principle of cooling and heating and the corresponding embodiment according to FIG. 4 can be applied to any appropriate and possible embodiment of present invention. The described process of heating and cooling is not obligatory bound to the structural features disclosed in the embodiment according to FIG. 4.

For some drilling actions, however, drilling mud or additives might be needed which could on the one hand impede or even stop the exothermic reaction needed for thermal fragmentation or which could on the other hand be destroyed by the hot temperatures in the hot reaction mixture and its neighbourhood. In such cases the downhole assembly as shown in FIG. 5 can be applied. It substantially contains all units and elements already discussed in FIG. 3 and optionally of FIG. 4. The main difference is based on the fact that two separate fluid sections in the borehole are developed downhole: The lower fluid section 201 mainly consists of water being brought downhole through the channel 202 of the drill string and ejected through channels/nozzles 203. This relatively pure water environment in the lower section 201 allows for the exothermic reaction 204 to establish and stabilize. If, however, for the current drilling operation, special drilling mud or additives are needed, which would impede the reaction or which would be destroyed by the high temperatures prevailing at the bottom of the borehole, they can be injected further downstream at the drilling fluid additives injection unit 205. The high upward velocity at the injection point (throat) prevents drilling mud or additives from flowing down in the water section 201. Thus the drilling fluid additives injection unit 205 separates the lower water section 201 from the upper section 206 containing drilling fluid additives (e.g. drilling mud) enabling the exothermic reaction downhole. The fluid and power supply of the downhole assembly illustrated in FIG. 5 must be equipped with one further conduit with respect to the system shown in FIG. 3: Two conduits for the reactants R1 and R2 207, 208 and one for electricity supply 209 are needed. But now two conduits are also needed for the drilling fluids: Water flows in the channel 202 and drilling mud or water plus additives, respectively, is transported in a separate conduit 210. Another method, however, comprises the downhole separation of a water-based drilling mud into more or less pure water and water plus additives downhole in the downhole assembly. In such a case only one conduit for drilling fluid has to be brought down. Yet another possibility is a mixture (e.g. emulsion) of a fuel (e.g. diesel oil) and water being brought down through the same conduit and being separated downhole. In this case water-based drilling mud can be fed through a separate conduit and again one feeding line becomes redundant.

The mixing unit 112 can be rotary stagnant or revolve along its axis X depending on whether or not the mechanical unit 110 is equipped with a downhole motor (FIG. 3A). The drilling heads of the down hole drilling assembly according to FIG. 6, 7A and 7B show a mixing unit 301 and two different outlet nozzle configurations for a non-rotary system, where the whole downhole assembly is rotary stagnant. In the configuration according to of FIG. 6 a central outlet nozzle 302 provides the hot reaction mixture, whereas the drilling fluid or pure water is ejected through an annular slot 303 around the central nozzle. The enhancement of thermal gradients within the surface rock layer as discussed above and in the summary of the invention can be realized by periodically varying heating and cooling conditions: The mass flow of the hot reaction mixture 304 permanently oscillates in a sinusoidal way, whereas the cooling fluid mass flow is kept constant. At times where the mass flow of the hot reaction mixture 304 peaks, the relevant rock surface is covered with the high temperature reaction zone 305 or at least the hot reaction mixture and the rock surface is heated rapidly. On the contrary, at times where the mass flow of the hot reaction mixture reaches its minimum, the reaction zone and/or the zone of the hot reaction mixture shrinks (or even disappears) and recedes to position 306. Now, the drilling fluid becomes predominant and flushes the rock surface, thus inducing a cooling of the rock surface. Alternatively or additionally, also the drilling fluid mass flow can be subject to oscillations. In latter case the flow of the reaction species can be kept constant. Alternatively, the hot reaction mixture can also be ejected through the annular slot 303 and the drilling fluid can be ejected through the central nozzle 302.

Another configuration for a non-rotary system is the one shown in FIG. 7A, 7B: The central nozzle 307 provides the drilling fluid, a plurality of nozzles 308 arranged circumferentially around the central nozzle provides the hot reaction mixture. With this nozzle configuration the maximum heat transfer to the rock surface does not occur along the central axis, but slightly laterally, where more rock has to be removed. The above mentioned technique to enhance thermal gradients can be applied here in the same manner: Either the cool drilling fluid mass flow or the hot reaction mixture mass flow or both mass flows are subject to permanent oscillations over time. Alternatively, the hot reaction mixture can also be ejected through the central nozzle 307 and the drilling fluid can be ejected through the nozzles 309 which are arranged around the central nozzle.

In FIG. 8A the mixing unit 401 constantly rotates along its axis (X axis) driven by a downhole motor in a mechanical unit 110. The hot reaction mixture leaves the mixing unit 401 at outlet nozzle 402, whereas the drilling fluid is ejected at outlet nozzle 403. Both nozzles are equipped with a swivel mechanism and can be constantly and symmetrically swiveled between a lateral position as shown in FIG. 8A and a central position 404 (dashed lines). The respective positions are also indicated in a cross sectional view in FIG. 8B (lateral position) and FIG. 8C (central position). The constant swiveling of the nozzles combined with the rotation of the whole device 401 make sure that heating and cooling, respectively, is distributed to all relevant parts of the rock surface (lateral and central positions). The fact that each part of the rock is alternately heated by outlet nozzle 402 and cooled by outlet nozzle 403 due to the rotation of the device 401 leads to an enhancement of the temperature gradient in the rock surface and therefore improve the thermal fragmentation process and enhance the penetration rate into the rock formation.

FIG. 9A and FIG. 9B shows another design for a rotary system using a plurality of fixed outlet nozzles for the drilling fluid and hot reaction mixture arranged circumferentially around the central axis of the mixing unit. The nozzles are placed in an alternating manner, such that 501 are the outlet nozzles for the cool drilling fluid and 502 are the nozzles for the hot reaction mixture stream. Like the design presented in FIGS. 8A, 8B and 8C, also in the design of FIGS. 9A and 9B the temporally changing heating and cooling conditions at a certain position of the rock surface lead to an improvement of the driving forces for thermal spallation processes, namely the temperature gradient inside the rock surface layer.

The reactants R1 and R2 reacting exothermically in zone 102 of FIG. 3A can be a commercial fuel (e.g. alcoholic fuel, natural gas, diesel—all of them optionally mixed with water) for the reactant R1 and an oxidant (e.g. air, oxygen) for the reactant R2. When the reactants (R1 and R2) are mixed with each other, an exothermic a combustion reaction can provide the necessary heat to spall the rock. However, since the reaction shown in FIG. 3A has to evolve and stabilize in the hostile environment of a water-based, pressurized drilling fluid (above 221 bar), the matter of establishing a flame (combustion reaction) is not trivial. The type of flame that can be used for such an application is the category of so-called hydrothermal flames that burn in an aqueous environment. The preferable operating conditions regarding stability and controllability of such a flame are a supercritical water environment at temperatures above 374° C. and pressures above 221 bar.

The pressure needed for stable hydrothermal flames is naturally given downhole below a certain depth of about 2.5 km, if the borehole is filled with a drilling fluid (water column, hydrostatic head). The critical temperature (374° C.), however, is generally not given in all relevant depths. Therefore, fuel and oxidant have to be heated up in the preheating unit 109 of FIG. 3A prior to flame ignition. By heating the reactants (R1 and R2) up to temperatures beyond the critical point even auto-ignition can be achieved, if the temperatures chosen are high enough. However, to save energy and costs for heating up the reactants a starting aid for the flame can be incorporated in the mixing unit 112 in FIG. 3A. This helps reducing the temperatures needed for ignition. Possibilities for ignition aids are spark plugs or solid catalysts that favour the combustion reaction and help lowering the characteristic activation energy locally. Apart from that also a pilot flame can be established within the mixing unit 112: A small portion of the overall fuel and oxidant mass flow is heated up beyond auto-ignition temperature and is brought together to form a small pilot flame inside the mixing unit 112 to ignite and later also support the main flame for thermal fragmentation of rock.

FIGS. 10 and 11 show two designs for the mixing unit 112, which have been proved practicable for generating hydrothermal flames. FIG. 10 shows a coaxial mixing configuration, where the two coaxial streams, the fuel stream 601 on the one hand and the stream of oxidant 602 on the other hand, are conducted within two coaxial tubes 603 and 604 and finally mix in the mixing zone 605 to form a turbulent, hydrothermal diffusion flame having its hot reaction zone 606 mainly outside the mixing unit in the aqueous environment of the drilling fluid 607. The mixing unit can optionally be equipped with a throat 608 in order to increase the fluid velocity towards the rock. At certain mass flow conditions even a lift-off flame can be achieved, where the flame front is lifted from the burner rim by the distance 609. This can help bringing the high temperature region of the reaction zone even closer to the rock surface. The distance denoted 610 is called the recess length and stands for the available mixing distance for fuel and oxidant before they exit the mixing unit 112 and enter the region in between downhole assembly and rock surface. Depending on the used drilling fluid a larger or shorter recess length might be necessary to guarantee a stable hydrothermal flame. It is also possible to conduct the fuel stream between the outer burner tube 604 and inner burner tube 603 and the oxidant stream in the inner burner tube 603.

FIG. 11A illustrates a radial mixing configuration: As for the coaxial design the fuel 611 is fed to the inner tube 612, whereas the oxidant 613 flows in the annular region in between the tubes. For this design, however, the fuel is injected laterally into the oxidant stream through small radial channels 614 (FIG. 11B) in the inner tube 612. Mixing of fuel and oxidant in the mixing zone 615 is enhanced with respect to the coaxial design of FIG. 10. However, the enhanced mixing properties due to the tangential velocity of the fuel stream in the mixing zone 615 are also accompanied with a slight increase in pressure drop. It is also possible to conduct the fuel stream in the annular region in between the two tubes and the oxidant stream in the inner burner tube 612.

Another design for the mixing unit 112 that can be applied to the non-rotary systems explained above is the slot configuration of FIG. 12A and FIG. 12B. Here drilling fluid is fed through the middle channel 616 along the central axis of the mixing unit and leaves the assembly at the central nozzle 617. The hydrothermal flame 618 is stabilized on a ring around the channel for the drilling fluid. Fuel is introduced at 619 and flows through the small diameter holes 620 drilled into the toroidal body 621. The fuel leaves the body 621 at a circular array of outlet nozzles 622 and mixes with the oxidant. The oxidant enters the mixing unit at 623 and is run along two communicating, toroidal gaps 624, which are connected through communicating channels 625. The optional neck 626 on either side of the toroidal body 621 causes a pressure drop in the stream of oxidant and causes enhanced distribution of oxidant over both gaps 624. The two separate oxygen streams come together at point 627 (mixing zone), where they mix with the fuel stream. This slot configuration makes sure a good heat flux distribution to the rock surface and can easily been mounted: The three main parts, the outer body 628, and the toroidal bodies 621 and 629 can be screwed together and tightened by sealing rings 630.

The downhole assembly described above can be combined with state-of-the-art drilling rigs. Since the use of a drilling fluid is contemplated in the present invention the general framework can be compared to that of a conventional, rotary drilling rig, except for the need of two reactants downhole. So, if the present investigation is to be integrated in a state-of-the-art drilling rig, solutions have to be found as how to feed the reactants to the downhole assembly. Two possibilities are shown in FIGS. 13 and 14. FIG. 13 shows the derrick 701 of a rotary drilling rig. The traveling block 702 and everything attached to it including the drilling string 703 can be moved up and down by the draw works 704. The drilling fluid 705 is brought to the connection unit 706 via a flexible hose 707 and flows down inside the drilling string 703. In this case, where the drilling string 703 is rotary stagnant, the connection unit 706 does not have to be designed as a swivel. The two reactants R1 and R2 are fed to the systems at point 708 and 709, respectively, where they enter separate flexible hoses 710, 711, which are connected to the downhole assembly 712 establishing the exothermic reaction 713. The flexible hoses 710, 711 containing the reactants are run outside in the annular region between drill string and borehole wall filled predominantly with the drilling fluid and the suspended cuttings. Up hole the flexible hoses 710 and 711 are coiled up on large rolls 714 and 715. The blowout prevention unit 716 also seals the drill string and both flexible hoses running through the unit. The returning drilling fluid containing cuttings and reaction products leaves the blowout prevention unit at 717. The drilling fluid is cleaned and re-injected at 705.

The drilling rig of FIG. 14 works in a similar manner. However, here, the flexible hoses for the reactants are run through the interior of the drilling string 718, thus being protected from the up flowing drilling fluid containing abrasive cuttings. The whole drilling string is a composition of many rods connected to each other. Two cross sections of such a single rod are illustrated in FIG. 15A: The drill rod 719 contains two flexible hoses 720, 721, which have opposite connectors on both ends 722, 723 and are loosely hold in place by the fixing plate 724. The reactant R1 and R2 are brought down to the assembly 725 inside the respective flexible hoses 726. In the shell region 727 the drilling fluid is transported down. Whenever a new drill rod has to be added to the string, the flexible pipes of the new rod introduced have to be connected to those of the drilling string below. After that the rod itself is connected firmly to the rest of the drill string. An advantage of this system with respect to the system shown in FIG. 13 is the sealing of the drilling sting: Whereas in FIG. 13 three pipes have to be sealed, the blowout prevention unit 728 of FIG. 14 only has to seal the drilling string as in rotary drilling systems. Drilling fluid 729 and reactants 730, 731 are fed to the connector unit 732 through flexible pipes 733. In all systems depicted in FIG. 13, 14, 15A and 15B also cables for electricity could be run down the borehole in the same way as described above.

Having the downhole assembly for thermal rock fragmentation connected to a state-of-the-art, rotary drilling rig with a rigid drilling string as discussed above opens also possibilities to combine rotary and spallation drilling technology to benefit from advantages of each single drilling technique. Conventional rotary drilling and spallation drilling technology (thermal rock fragmentation) can be used contemporaneously to excavate a borehole in two ways both utilizing a downhole motor driven by the drilling fluid flow: A small diameter pilot hole is pre-drilled by thermal spallation drilling using an exothermic reaction as described above. A mechanical under-reamer driven by the downhole motor and sitting on top of the downhole assembly reams out the borehole to a larger diameter as the drill string is lowered. The second way of making simultaneous use of rotary and spallation drilling is the opposite of the above mentioned process: A mechanical drill bit attached to the very bottom of the downhole assembly pre-drills a small diameter hole, whereas streams of hot reaction mixture are ejected laterally further above to enlarge the pre-drilled holes thermally.

Yet another opportunity to use a combination of rotary and thermal drilling technology is offered, when both processes are used alternately: The lower part of the downhole assembly consists of a mechanical drill bit and is rotated by means of a downhole motor. At the bottom side of the drill bit there are separate nozzles for the ejection of a drilling fluid and a stream of hot reaction mixture. For mechanical drilling action the whole downhole assembly is pressed against the rock surface to mechanically grind the rock beneath without starting the exothermic reaction. For thermal fragmentation the downhole assembly is brought to a position slightly distant from the rock underneath (in the range of centimeters). After the initialization of the exothermic reaction the rock can be treated thermally by making the hot reaction mixture impinge onto the rock surface through the nozzles at the bottom side of the drill bit.

In FIG. 16 an autonomous system for thermally fragment rock not based on rotary, state-of-the-art drilling rigs is shown. The core of this system is the flexible pipe 801 containing separate conducts for both reactants, the drilling fluid and the electricity. These means required downhole are all transported to the downhole assembly 802 through the hose 801. The downhole assembly itself is equipped with lateral stabilizers 803, which have different tasks to fulfill: They stabilize the downhole assembly in the borehole in case the flexible pipe 801 does not provide enough stability. Furthermore, they also help moving the whole device 802 downwards as drilling operation proceeds. The stabilizers 803 can be realized as inflatable packers or even moving caterpillars. The hose is coiled up on a large roll 804, where all required means (Reactants R1 805 and R2 806, drilling fluid 807 and electricity 808) are fed to the connector unit 809. The hose 801 is sealed at the blow out prevention unit 810. The drilling fluid containing the suspended cuttings and reaction products is transported up in the annulus between borehole wall and hose 801 and leaves the borehole at 811 to be cleaned and re-injected at 807.

The invention claimed is:

1. A method of thermal rock fragmentation in a borehole by an exothermic chemical reaction of at least two reactants in the presence of a water-based drilling fluid having a pressure of more than 1.5 bar, the method comprising the steps of:

feeding the water-based drilling fluid to a downhole assembly in a borehole and ejecting said drilling fluid from the downhole assembly into the borehole;

feeding the reactants for said exothermic reaction via feeding lines to said downhole assembly;

forming a mixing zone by bringing the reactants together via outlets in the feeding lines and mixing said reactants in the mixing zone; and establishing the exothermic reaction of the reactants in a reaction zone, the reaction zone being located in a volume between the outlets of the feeding lines into said mixing zone and a rock surface in the borehole, wherein the reaction at least partly takes place in the presence of water-based drilling fluid, wherein the exothermic chemical reaction is in the presence of a water-based drilling fluid having a pressure corresponding to or exceeding the critical pressure of water.

2. The method of claim 1, wherein a hot reaction mixture leaves the downhole assembly, and is ejected from the downhole assembly through outlet nozzles.

3. The method of claim 1, further comprising the step of: directing a hot reaction mixture towards the rock surface so as to cause said hot reaction mixture to impinge on the rock surface.

4. The method according to claim 1, wherein said reactants are preheated in a preheating zone of said downhole assembly before, during and/or after mixing by providing heating power to said reactants.

5. The method according to claim 4, wherein the heating power for preheating the reactants is reduced after the exothermic reaction has been established and stabilized.

6. The method according to claim 1, wherein drilling fluid additives are brought to said downhole assembly through a separate conduit and said drilling fluid additives are injected into an annular region of the upward fluid stream containing rock fragments at an upper part of said downhole assembly, thus creating an aqueous hot reaction zone in a bottom region of the borehole and a separate upward fluid stream region containing said drilling fluid additives.

7. The method according to claim 1, wherein the reactants or a hot reaction mixture are subjected to a mass flow having oscillatory variations over time, thus providing time-dependent heat flux to the rock and inducing enhanced temperature gradients within a near-surface region of the rock that is to be fragmented.

8. The method according to claim 1, wherein said drilling fluid or a portion of it has a mass flow that is subjected to variations over time, thus providing time-dependent cooling of the rock surface and inducing enhanced temperature gradients within a near-surface region of the rock that is to be fragmented.

9. The method according to claim 1, wherein the water-based drilling fluid is ejected from said downhole assembly at a plurality of nozzles, and wherein a distribution of the total mass flow to each single of said nozzles is varied over time to provide temporally and spatially varying cooling conditions for the rock surface.

10. The method according to claim 1, wherein the downhole assembly comprises a lower part that is rotatable about a central axis of the downhole assembly, the lower part containing one or more outlet nozzles for a hot reaction mixture and/or one or more separate outlet nozzles for the drilling fluid.

11. The method according to claim 10, wherein the rotating lower part of the downhole assembly comprises one or more first outlet nozzles for said hot reaction mixture and one or more second outlet nozzles for drilling fluid, wherein the first and second outlet nozzles are arranged alternately along the rotation direction to provide alternating heating and cooling conditions to the rock surface while rotating the lower part about the central axis of the downhole assembly, thus inducing enhanced temperature gradients within the near-surface region of the rock that is to be fragmented.

12. The method according to claim 1, wherein a mechanical drilling unit is coupled to said downhole assembly in order to use a combination of said exothermic reaction and mechanical drilling acting contemporaneously or alternating in order to excavate a borehole.

13. The method according to claim 12, wherein said mechanical drilling unit is located at an upper part of said downhole drilling assembly and is used to ream out a pilot hole drilled by said exothermic reaction.

14. The method according to claim 12, wherein a pilot hole is drilled by means of said mechanical drilling unit located at a bottom part of said downhole assembly and the borehole size is enlarged in diameter by said hot reaction mixture directed laterally to the rock surface in an upper part of the downhole assembly.

15. The method according to claim 1, wherein drilling fluid is added to at least one of the reactants, before entering the mixing zone and/or is added directly to the mixing zone and/or to the reaction zone to control heat and momentum transfer to the rock surface as well as the temperature of the hot reaction mixture impinging on the rock.

16. The method according to claim 1, wherein said reactants comprise a fuel and an oxidant, the exothermic reaction forming a hydrothermal flame which at least partly burns in the presence of water-based drilling fluid and whose hot reaction mixture is directed towards the rock surface.

17. The method according to the claim 16, wherein the hydrothermal flame is ignited by spark ignition or by auto-ignition after preheating said fuel and oxidant up to their self-ignition temperature.

18. The method according to the claim 16, wherein said hydrothermal flame is ignited and supported by a smaller pilot flame which is located upstream with respect to said hydrothermal flame used for thermal rock fragmentation.

19. A downhole drilling assembly for drilling a borehole in a rock formation using an exothermic chemical reaction of at least two reactants in the presence of a water-based drilling fluid having a pressure of more then 1.5 bar, said downhole drilling assembly, for carrying out the process according to claim 1, comprising:

inlets for reactants and water-based drilling fluid;

a mixing chamber, in which the mixing and optionally at least part of the reaction of said reactants are realized, and wherein feeding lines of the reactants end in the mixing chamber via outlet openings;

outlet nozzles for a reaction mixture; and means for direct and separate injection of water-based drilling fluid into the borehole and/or means for injection of water-based drilling fluid in the mixing chamber and/or means for injection of water-based drilling fluid into the outlet nozzle for the hot reaction mixture.

20. The downhole drilling assembly according to claim 19, further comprising a preheating unit to preheat said reactants before, during or after mixing.

21. The downhole drilling assembly according to claim 19, wherein an annular slot at the bottom of said downhole assembly is provided to emit the hot reaction mixture uniformly around an annulus, and wherein a central nozzle is provided to eject drilling fluid.

22. The downhole drilling assembly according to claim 19, wherein a plurality of outlet nozzles are arranged circumferentially around the axis of said downhole assembly to emit the hot reaction mixture, and wherein a central nozzle is provided to eject drilling fluid.

23. The downhole drilling assembly according to claim 19, wherein one central outlet nozzle is provided to emit the hot reaction mixture, and wherein an annular nozzle is provided around said central outlet nozzle to eject drilling fluid.

24. The downhole drilling assembly according to claim 19, wherein one central outlet nozzle is provided to emit the hot reaction mixture, and wherein a plurality of nozzles is provided around said central outlet nozzle to eject drilling fluid.

25. The downhole drilling assembly according to claim 19, wherein the downhole drilling assembly contains a lower part which is rotatable along its central axis.

26. The downhole drilling assembly according to claim 25, wherein said downhole drilling assembly comprises driving means which are capable of converting flow energy of the drilling fluid and/or the reacting mixture of reactants and/or the hot reaction mixture into rotational movement of said lower part of the downhole drilling assembly.

27. The downhole drilling assembly according to claim 25, wherein a plurality of outlet nozzles for the hot reaction mixture and drilling fluid are arranged circumferentially around the central axis at the bottom of the lower part and in an alternating manner.

28. The downhole drilling assembly according to claim 25, wherein one outlet nozzle for the hot reaction mixture and one outlet nozzle for drilling fluid are arranged symmetrically at the bottom of the lower part of the downhole drilling assembly and can optionally be swiveled each under an angle of more then 0° in order to provide uniform heat flux to the whole surface of the treated rock.

29. The downhole drilling assembly according to claim 19, wherein a mechanical drilling device is coupled to said downhole assembly in order to use a combination of said exothermic reaction and mechanical drilling acting alternating or contemporaneously in order to excavate a borehole.

* * * * *